US010803793B2

(12) United States Patent
Jang et al.

(10) Patent No.: US 10,803,793 B2
(45) Date of Patent: Oct. 13, 2020

(54) IMAGE DISPLAY APPARATUS

(71) Applicant: LG ELECTRONICS INC., Seoul (KR)

(72) Inventors: Joonduk Jang, Seoul (KR); Hyungil Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/161,309

(22) Filed: Oct. 16, 2018

(65) Prior Publication Data

US 2019/0114962 A1 Apr. 18, 2019

(30) Foreign Application Priority Data

Oct. 16, 2017 (KR) ..... 10-2017-0134216

(51) Int. Cl.

| | |
|---|---|
| ***G09G 3/3225*** | (2016.01) |
| ***G09G 3/3233*** | (2016.01) |
| ***G09G 3/20*** | (2006.01) |
| *G09G 3/3266* | (2016.01) |

(52) U.S. Cl.

CPC ..... *G09G 3/3225* (2013.01); *G09G 3/2096* (2013.01); *G09G 3/3233* (2013.01); *G09G 3/3266* (2013.01); *G09G 2300/0842* (2013.01); *G09G 2300/0866* (2013.01);

(Continued)

(58) Field of Classification Search

CPC ..... G09G 3/3225; G09G 3/3266; G09G 2340/16; G09G 2310/063

See application file for complete search history.

(56) References Cited

U.S. PATENT DOCUMENTS

| | | | | |
|---|---|---|---|---|
| 2005/0062686 | A1* | 3/2005 | Iguchi | G09G 3/3233 345/46 |
| 2005/0168417 | A1* | 8/2005 | Ha | G09G 3/3291 345/76 |
| 2007/0030219 | A1 | 2/2007 | Park et al. | |

(Continued)

FOREIGN PATENT DOCUMENTS

| | | |
|---|---|---|
| KR | 10-1456150 | 11/2014 |
| KR | 10-1552991 | 9/2015 |
| KR | 10-2017-0080218 | 7/2017 |

OTHER PUBLICATIONS

International Search Report dated Feb. 22, 2019 issued in Application No. PCT/KR2018/011968.

*Primary Examiner* — Shaheda A Abdin

(74) *Attorney, Agent, or Firm* — KED & Associates LLP

(57) ABSTRACT

The present invention relates to an image display apparatus. The image display apparatus according to an embodiment of the present invention a display including an organic light-emitting diode (OLED) panel, and a controller to control the OLED panel, in which, in a case where an image to be displayed on the OLED panel is a moving image, during a first duration, the display displays a portion of a first frame image on a first area of the OLED panel and displays a portion of a second frame image before the first frame image on a second area other than the first area of the OLED panel, and in which, in the case where the image to be displayed on the organic light-emitting is the moving image, during a second duration after the first duration, the display displays a black image on all display areas of the OLED panel.

16 Claims, 18 Drawing Sheets

(52) U.S. Cl.
CPC . *G09G 2310/063* (2013.01); *G09G 2320/103* (2013.01); *G09G 2340/16* (2013.01); *G09G 2354/00* (2013.01)

(56) References Cited

U.S. PATENT DOCUMENTS

| | | | | |
|---|---|---|---|---|
| 2008/0218448 | A1* | 9/2008 | Park ..... | G09G 3/2014 345/76 |
| 2010/0045644 | A1 | 2/2010 | Lee et al. | |
| 2012/0038608 | A1 | 2/2012 | Seo et al. | |

* cited by examiner

IMAGE DISPLAY APPARATUS

CROSS-REFERENCE TO RELATED APPLICATION

This application claims the priority benefit of Korean Patent Application No. 10-2017-0134216, filed on Oct. 16, 2017 in the Korean Intellectual Property Office, the disclosure of which is incorporated herein by reference.

BACKGROUND OF THE INVENTION

1. Field of the Invention

The present invention relates to an image display apparatus, and more particularly to an image display apparatus equipped with an organic light-emitting diode (OLED) panel, in which a panel response speed is improved when displaying a moving image.

2. Description of the Related Art

An image display apparatus is an apparatus that has a function of providing an image which is capable of being viewed by a user. The user views various images through the image display apparatus.

Particularly, the image display apparatus displays a broadcast image. The image display apparatus provides a broadcast signal selected by the user from among broadcast signals that are transmitted from a broadcasting station. A broadcast image that results from the selected broadcast signal is displayed on a display of the image display apparatus.

On the other hand, the image display apparatus displays an image using one among various types of panels. In recent years, the use of a high-definition organic light-emitting diode (OLED) panel in the image display apparatus has increased, due to element characteristics, a hold-type panel is employed On the other hand as the organic light-emitting diode (OLED) panel. In the hold-type panel, a phenomenon where an image leaves a trail occurs when displaying the image. Various techniques for solving this problem have been studied.

SUMMARY OF THE INVENTION

It is an object of the present invention to provide an image display apparatus equipped with an organic light-emitting diode (OLED) panel, in which a panel response speed is improved when displaying a moving image.

It is another object of the present invention to provide an image display apparatus equipped with an organic light-emitting diode (OLED) panel, in which an image is displayed in accordance with a high image quality standard when displaying a moving image.

According to an embodiment of the present invention, there is provided an image display apparatus according to an embodiment of the present invention, including a display including an organic light-emitting diode (OLED) panel, and a controller to control the organic light-emitting diode (OLED) panel, in which, in a case where an image to be displayed on the OLED panel is a moving image, during a first duration, a portion of a first frame image is displayed on a first area of the organic light-emitting diode (OLED) panel of the display and a portion of a second frame image before the first frame image is displayed on a second area other than the first area of the organic light-emitting diode (OLED) panel of the display, and in which, in the case where the image to be displayed on the organic light-emitting is the moving image, during a second duration after the first duration, a black image is displayed on all display areas of the organic light-emitting diode (OLED) panel of the display.

In addition, according to another embodiment of the present invention, there is provided an image display apparatus including: a display including an organic light-emitting diode (OLED) panel, and a controller to control the organic light-emitting diode (OLED) panel, in which the organic light-emitting diode (OLED) panel includes a plurality of pixels, in which the pixel includes an organic light-emitting layer, a drive switching element connected to an anode of the organic light-emitting layer and performs switching, and a first switching element connected between a cathode of the organic light-emitting layer and the ground, in which, in a case where panel response time adjustment is necessary, the display applies a pulse voltage to the cathode of the organic light-emitting layer.

In addition, according to another embodiment of the present invention, there is provided an image display apparatus including: a display including an organic light-emitting diode (OLED) panel, and a controller to control the organic light-emitting diode (OLED) panel, in which, in a case where panel response time adjustment is necessary, during a first duration, the display displays a portion of an n frame image on an upper portion of the organic light-emitting diode (OLED) panel and displays a portion of an n−1 frame image on a lower portion of the organic light-emitting diode (OLED) panel, and in which, in the case where the panel response time adjustment is necessary, during a second duration after the first duration, the display displays a black image on all display areas of the organic light-emitting diode (OLED) panel.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

The present invention will be described in detail below with reference to the drawings.

The terms "module" and "unit" that will be used in the following description to name a constituent element are assigned only for ease of description in the present specification, and are not in themselves intended particularly to attach an important meaning or to provide important functionality. Therefore, the terms "module" and "unit" may be used interchangeably.

Figure 1:
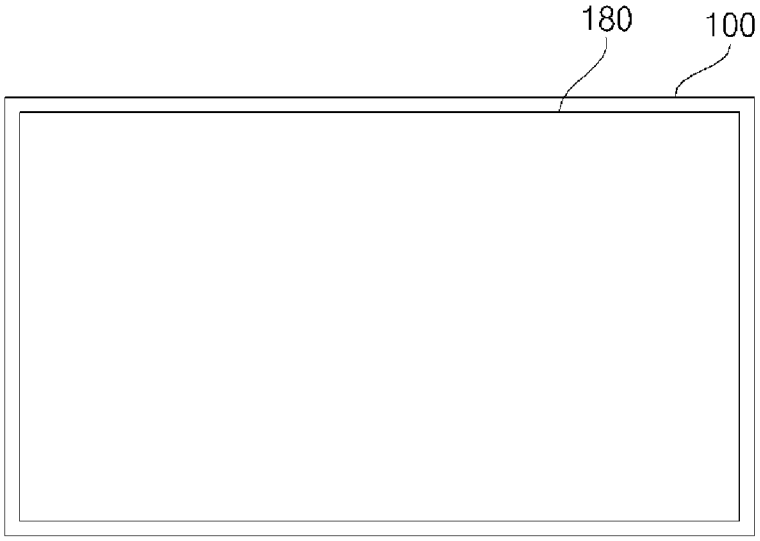
FIG. 1 is a diagram illustrating an image display apparatus according to an embodiment of the present invention.

FIG. 1 is a diagram illustrating an image display apparatus according to an embodiment of the present invention.

With reference to the drawings, an image display apparatus 100 includes a display 180.

On the other hand, the display 180 is realized by one among various panels. For example, the display 180 is one of the following panels: a liquid crystal display panel (LCD panel), an organic light-emitting diode (OLED) panel (OLED panel), and an inorganic light-emitting diode (OLED) panel (ILED panel).

According to the present invention, the display 180 is assumed to include an organic light-emitting diode (OLED) panel (OLED).

On the other hand, an organic light-emitting diode (OLED) panel (OLED) has a faster panel response time than a liquid crystal display panel, has the excellent effect of color reproduction, and is a hold-type panel. Accordingly, a phenomenon where an image leaves a trail occurs when displaying a moving image.

According to the present invention, in order to solve this problem, a black image is inserted, for display, between frame images.

Specifically, the image display apparatus 100 according to the embodiment of the present invention includes an organic light-emitting diode (OLED) panel 210 and a controller 170 or 232 that controls the OLED panel 210. In the image display apparatus 100, in a case where an image to be displayed on the OLED panel 210 is a moving image, during a first duration, the display 180 displays a portion of a first frame image on a first area of the OLED panel 210 and displays a portion of a second frame image before the first frame image on a second area other than the first area of the OLED panel 210. Furthermore, in the image display apparatus 100, during a second duration after the first duration, the display 180 displays a black image on all display areas of the OLED panel 210. Thus, a panel (210) response speed is improved when displaying the moving image.

Accordingly, an image is displayed in accordance with a high image quality standard when the moving image is displayed on the image display apparatus 100 that includes the OLED panel 210.

On the other hand, the more an amount of movement of an object within the moving image is increased with the amount of the movement being equal to or greater than a predetermined value, the more the second duration during which the black image is displayed is set to be lengthened rather than the first duration. Thus, the panel (210) response time is adaptively improved when displaying the moving image.

Particularly, in the case where the moving image to be displayed on the OLED panel 210 is the moving image, a first voltage VDD is applied to a drive switching element SW2, and a pulse voltage Vps is applied to a cathode of an organic light-emitting layer (OLED). Thus, frame image display during the first duration and black image display during the second duration are simply realized.

On the other hand, during a third duration after the second duration, a third frame image after the first frame image is displayed on the first area of the OLED panel 210, and another portion of the first frame image stored in a storage capacitor Cst is displayed on the second area of the OLED panel 210. Thus, the panel (210) response speed is improved when displaying the moving image.

On the other hand, an image display apparatus 100 according to another embodiment of the present invention includes the OLED panel 210 and the controller 170 or 232 that controls the OLED panel 210. In the image display apparatus 100, the OLED panel 210 includes a plurality of pixels, each of which has the organic light-emitting layer (OLED), the drive switching element SW2 connected to an anode of the organic light-emitting layer (OLED) and performs switching, and a first switching element SW3 connected between the cathode of the organic light-emitting layer (OLED) and the ground. In the image display apparatus 100, in a case where panel response time adjustment is necessary, the display applies the pulse voltage Vps to the cathode of the organic light-emitting layer (OLED). Thus, the panel (210) response speed is improved.

On the other hand, an image display apparatus 100 according to still another embodiment of the present invention includes the OLED panel 210 and the controller 170 or 232 that controls the OLED panel 210. In the image display apparatus 100, in the case where the panel response time adjustment is necessary, during the first duration, the display 180 displays a portion of an n frame image on an upper portion of the OLED panel 210 and displays a portion of an n−1 frame image on a lower portion of the OLED panel 210. Furthermore, during the second duration after the first duration, the display 180 displays the black image on all display areas of the OLED panel 210. Thus, the panel (210) response speed is improved when displaying the moving image.

Various methods in the image display apparatus 100 described above operates will be described in more detail below with reference to FIG. 8 and subsequent figures.

On the other hand, examples of the image display apparatus 100 in FIG. 1 include a monitor, a TV, a tablet PC, a mobile terminal, and so on.

Figure 2:
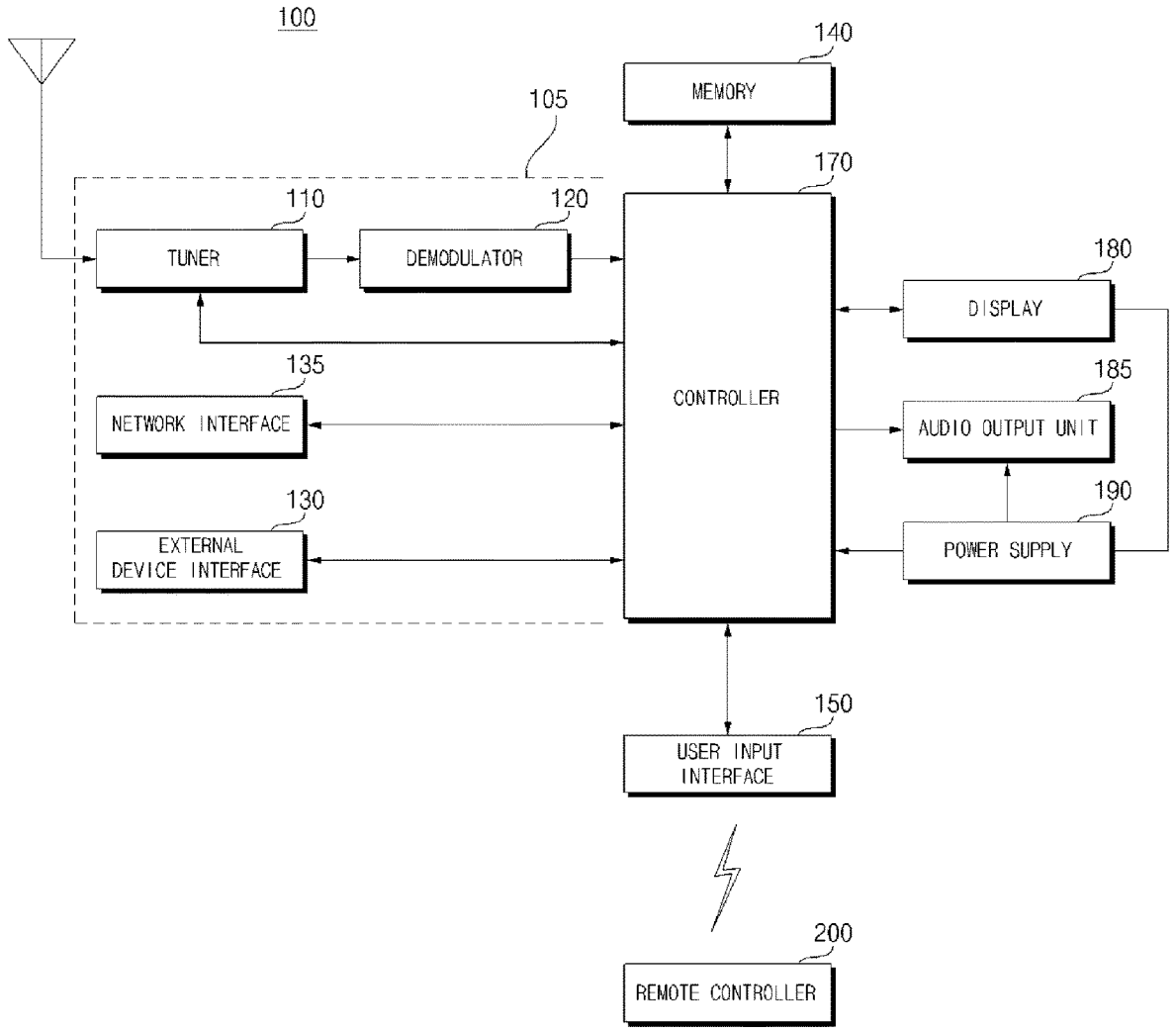
FIG. 2 is an example of a block diagram of the inside of the image display apparatus in FIG. 1.

FIG. 2 is an example of a block diagram of the inside of the image display apparatus in FIG. 1.

With reference to FIG. 2, the image display apparatus 100 according to an embodiment of the present invention includes a broadcast reception unit 105, an external device interface 130, a memory 140, a user input interface 150, a sensor unit (not illustrated), a controller 170, a display 180, and an audio output unit 185.

The broadcast reception unit 105 includes a tuner unit 110, a demodulator 120, a network interface 135, and an external device interface 130.

On the other hand, unlike in the drawings, it is also possible that the broadcast reception unit 105 only includes the tuner unit 110, the demodulator 120, and the external device interface 130. That is, the network interface 135 may not be included.

The tuner unit 110 selects a radio frequency (RF) broadcast signal that corresponds to a channel which is selected by a user, or RF broadcast signals that correspond to all channels that are already stored, among RF broadcast signals that are received through an antenna (not illustrated). In addition, the selected RF broadcast signal is converted into an intermediate frequency signal, a baseband image, or an audio signal.

For example, the selected RF broadcast signal, if is a digital broadcast signal, is converted into a digital IF (DIF) signal, and, if is an analog broadcast signal, is converted into an analog baseband image or an audio signal (CVBS/SIF). That is, the tuner unit 110 processes a digital broadcast signal or an analog broadcast signal. The analog baseband image or the audio signal (CVBS/SIF) output from the tuner unit 110 is input directly into the controller 170.

On the other hand, the tuner unit 110 possibly includes a plurality of tuners in order to receive broadcast signals in a plurality of channels. In addition, it is also possible that a signal tuner that receives the broadcast signals in the plurality of channels at the same time is included.

The demodulator 120 receives a digital IF(DIF) signal that results from the conversion in the tuner unit 110 and performs a demodulation operation on the received digital IF signal.

The demodulator 120 performs demodulation and channel decoding, and then outputs a stream signal (TS). At this time, the stream signal is a signal that results from multiplexing image signals, audio signals, or data signals.

The stream signal output from the demodulator 120 is input into the controller 170. The controller 170 performs demultiplexing, video and audio signal processing, and so on, and then outputs the resulting image to the display 180 and outputs the resulting audio to the audio output unit 185.

The external device interface 130 transmits or receives data to and from an external apparatus (not illustrated) connected, for example, a set-top box 50. To do this, the external device interface 130 includes an A/V input and output unit (not illustrated).

The external device interface 130 is connected in a wired or wireless manner to an external apparatus, such as a digital versatile disc (DVD), a Blu-ray disc, a game device, a camera, a camcorder, a computer (a notebook computer), or a set-top box, and may perform inputting and outputting operations for reception and transmission of data to and from the external apparatus.

An image and an audio signal of the external apparatus are input into the A/V input and output unit. On the other hand, a wireless communication unit (not illustrated) performs a short-distance wireless communication with a different electronic apparatus.

Through the wireless communication unit (not illustrated), the external device interface 130 transmits and receives data to and from the nearby mobile terminal 600. Particularly, in a mirroring mode, the external device interface 130 receives device information, information on an application executed, an application image, and so on from the mobile terminal 600.

The network interface 135 provides an interface for connecting the image display apparatus 100 to wired and wireless networks including the Internet. For example, the network interface 135 receives items of content or pieces of data pieces that are provided by a content provider or a network operator through a network or the Internet.

On the other hand, the network interface 135 includes the wireless communication unit (not illustrated).

A program for controlling processing or control of each signal within the controller 170 may be stored in the memory 140. An image signal, an audio signal, or a data signal, which results from signal processing, may be stored in the memory 140.

In addition, an image signal, an audio signal, or a data signal, which is input into the external device interface 130, may be temporarily stored in the memory 140. In addition, information on a predetermined broadcast channel may be stored in the memory 140 through a channel storage function such as a channel map.

An embodiment in which the memory 140 is provided separately from the controller 170 is illustrated in FIG. 2, but the scope of the present invention is not limited to this. The memory 140 is included within the controller 170.

The user input interface 150 transfers a signal input by the user, to the controller 170, or transfers a signal from the controller 170 to the user.

For example, user input signals, such as power-on and -off signals, a channel selection signal, and a screen setting signal, are transmitted and received to and from a remote controller 200, user input signals that are input from local keys (not illustrated), such as a power key, a channel key, a volume key, and a setting key, are transferred to the controller 170, a user input signal input from the sensing unit (not illustrated) that senses a user's gesture is transferred to the controller 170, or a signal from the controller 170 is transmitted to the sensing unit (not illustrated).

The controller 170 demultiplexes a stream input through the tuner unit 110, the demodulator 120, the network interface 135, the external device interface 130, or processes signals that results from demultiplexing, and thus generates and outputs a signal for outputting an image and audio.

An image signal that results from image-processing in the controller 170 is input into the display 180, and an image that corresponds to the image signal is displayed. In addition, the image signal that results from the image-processing in the controller 170 is input into an external output apparatus through the external device interface 130.

An audio signal that results from processing in the controller 170 is output, as audio, to the audio output unit 185. In addition, an audio signal that results from processing in the controller 170 is input into an external output apparatus through the external device interface 130.

Although not illustrated in FIG. 2, the controller 170 includes a demultiplexer, an image processing unit, and so on. The details of this will be described below with reference to FIG. 3.

In addition, the controller 170 controls an overall operation within the image display apparatus 100. For example, the controller 170 controls the tuner unit 110 in such a manner that the tuner unit 110 performs selection of (tuning to) a RF broadcast that corresponds to a channel selected by the user or a channel already stored.

In addition, the controller 170 controls the image display apparatus 100 using a user command input through the user input interface 150, or an internal program.

On the other hand, the controller 170 controls the display 180 in such a manner that an image is displayed. At this time, the image displayed on the display 180 is a still image, or a moving image, and is a 2D image or a 3D image.

On the other hand, the controller 170 is configured to a predetermined object is displayed within the image displayed on the display 180. For example, the object is at least one of the following: a web screen (a newspaper, a magazine, or so on) connected, an electronic program guide (EPG), various menus, a widget, an icon, a still image, a moving image, and text.

On the other hand, the controller 170 recognizes a location of the user, based on an image captured by an imaging unit (not illustrated). For example, a distance (a z-axis coordinate) between the user and the image display apparatus 100 is measured. In addition, a x-axis coordinate and a y-axis coordinate within the display 180, which correspond to the location of the user are calculated.

The display 180 converts an image signal, a data signal, an OSD signal, a control signal that result from the processing in the controller 170, or an image signal, a data signal, a control signal, and so on that are received in the external device interface 130, and generates a drive signal.

On the other hand, the display 180 is configured with a touch screen, and thus is also possibly used as an input device, in addition to an output device.

The audio output unit 185 receives a signal that results from audio processing the controller 170, as an input, and outputs the signal, as audio.

The imaging unit (not illustrated) captures an image of the user. The imaging unit (not illustrated) is realized as one camera, but is not limited to the one camera. It is also possible that the image unit is realized as a plurality of cameras. Information of an image captured by the imaging unit (not illustrated) is input into the controller 170.

Based on the image captured by the imaging unit (not illustrated), or on an individual signal detected by the sensing unit (not illustrated) or a combination of the detected individual signals, the controller 170 detects the user's gesture.

A power supply unit 190 supplies required powers to the entire image display apparatus 100. Particularly, a power is supplied to the controller 170 realized in the form of a system-on-chip (SOC), the display 180 for image display, the audio output unit 185 for audio output, and so on.

Specifically, the power supply unit 190 includes a converter that converts an alternating current power into a direct current power, and a dc/dc converter that converts a level of the direct current power.

The remote controller 2 transmits a user input to the user input interface 150. To do this, the remote controller 200 employs Bluetooth, radio frequency (RF) communication, infrared (IR) communication, ultra-wideband (UWB), a ZigBee specification, and so on. In addition, the remote controller 200 receives an image signal, an audio signal, or a data signal output from the user input interface 150, and displays the received signal on a display unit of the remote controller 200*f* or outputs the received signal, as audio, to an output unit of the remote controller 200.

On the other hand, the image display apparatus 100 described above is a digital broadcast receiver that possibly receives a fixed-type or mobile-type digital broadcast.

Figure 3:
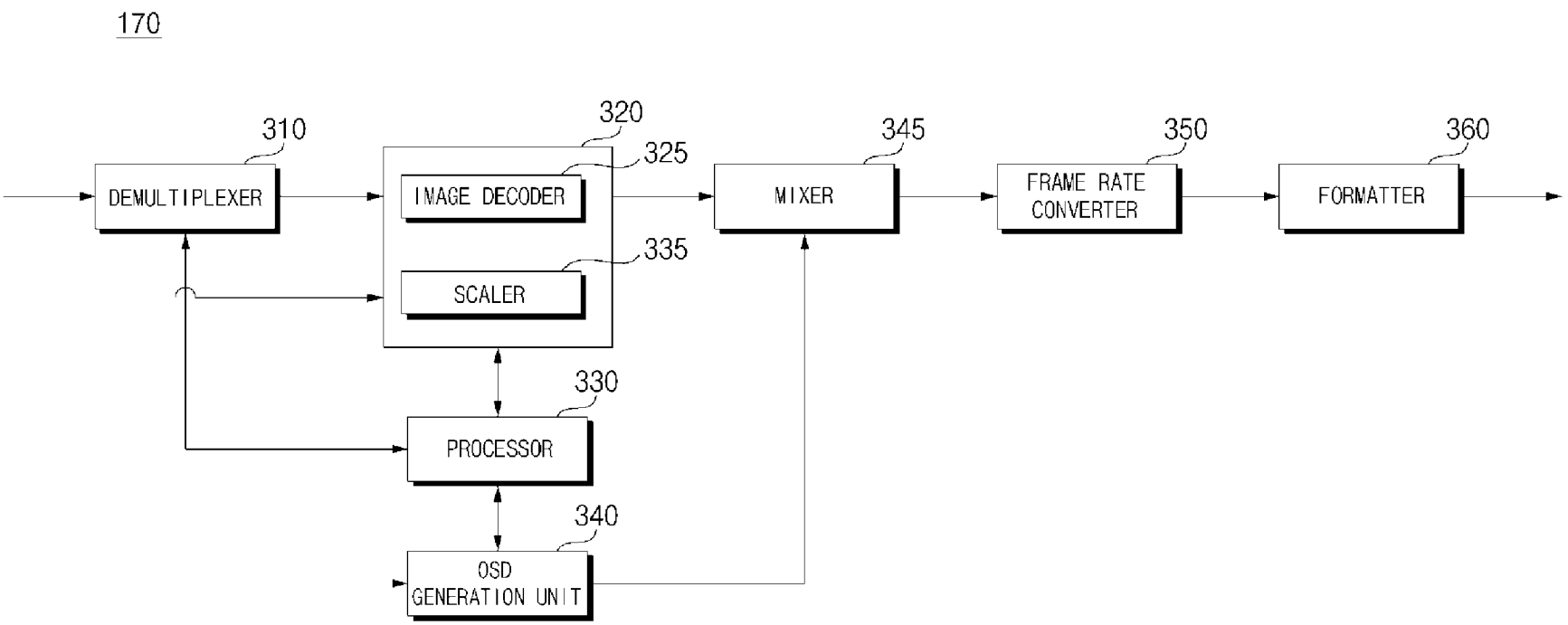
FIG. 3 is an example of a block diagram of the inside of a controller in FIG. 2.

On the other hand, a block diagram of the image display apparatus 100 illustrated in FIG. 2 is a block diagram for an embodiment of the present invention. Each constituent element in the block diagram is subject to integration, addition, or omission according to specifications of the image display apparatus 100 actually realized. That is, two or more constituent elements are to be integrated into one constituent element, or one constituent element is to be divided into two or more constituent elements. In addition, a function performed in each block is for description of an embodiment of the present invention, and specific operation of each constituent element imposes no limitation to the scope of the present invention. FIG. 3 is an example of a block diagram of the inside of a controller in FIG. 2.

For description with reference to the drawings, the controller 170 according to an embodiment of the present invention includes a demultiplexer 310, an image processing unit 320, a processor 330, an OSD generation unit 340, a mixer 345, a frame rate converter 350, and a formatter 360. In addition, an audio processing unit (not illustrated) and a data processing unit (not illustrated) are further included.

The demultiplexer 310 demultiplexes a stream input. For example, in a case where an MPEG-2 TS is input, the MPEG-2 TS is demultiplexed into an image signal, an audio signal, and a data signal. At this point, a stream signal input into the demultiplexer 310 is a stream signal output from the tuner unit 110, the demodulator 120, or the external device interface 130.

The image processing unit 320 performs image processing of the image signal that results from the demultiplexing. To do this, the image processing unit 320 includes an image decoder 325 or a scaler 335.

The image decoder 325 decodes the image signal that results from the demultiplexing. The scaler 335 performs scaling in such a manner that a resolution of an image signal which results from the decoding is such that the image signal is possibly output to the display 180.

Examples of the image decoder 325 possibly include decoders in compliance with various specifications. For example, the examples of the image decoder 325 include a decoder for MPEG-2, a decoder for H.264, a 3D image decoder for a color image and a depth image, a decoder for a multi-point image, and so on.

The processor 330 controls an overall operation within the image display apparatus 100 or within the controller 170. For example, the processor 330 controls the tuner unit 110 in such a manner that the tuner unit 110 performs the selection of (tuning to) the RF broadcast that corresponds to the channel selected by the user or the channel already stored.

In addition, the processor 330 controls the image display apparatus 100 using the user command input through the user input interface 150, or the internal program.

In addition, the processor 330 performs control of transfer of data to and from the network interface 135 or the external device interface 130.

In addition, the processor 330 controls operation of each of the demultiplexer 310, the image processing unit 320, the OSD generation unit 340, and so on within the controller 170.

The OSD generation unit 340 generates an OSD signal, according to the user input or by itself. For example, based on the user input signal, a signal is generated for displaying various pieces of information in a graphic or text format on a screen of the display 180. The OSD signal generated includes various pieces of data for a user interface screen of the image display apparatus 100, various menu screens, a widget, an icon, and so on. In addition, the OSD generated signal includes a 2D object or a 3D object.

In addition, based on a pointing signal input from the remote controller 200, the OSD generation unit 340 generates a pointer possibly displayed on the display. Particularly, the pointer is generated in a pointing signal processing unit, and an OSD generation unit 240 includes the pointing signal processing unit (not illustrated). Of course, it is also possible that instead of being providing within the OSD generation unit 240, the pointing signal processing unit (not illustrated) is provided separately.

The mixer 345 mixes the OSD signal generated in the OSD generation unit 340, and the image signal that results from the image processing and the decoding in the image processing unit 320. An image signal that results from the mixing is provided to the frame rate converter 350.

The frame rate converter (FRC) 350 converts a frame rate of an image input. On the other hand, it is also possible that the frame rate converter 350 outputs the image, as is, without separately converting the frame rate thereof.

On the other hand, the formatter 360 converts a format of the image signal input, into a format for an image signal to be displayed on the display, and outputs an image that results from the conversion of the format thereof.

The formatter 360 changes the format of the image signal. For example, a format of a 3D image signal is changed to any one of the following various 3D formats: a side-by-side format, a top and down format, a frame sequential format, an interlaced format, and a checker box format.

On the other hand, the audio processing unit (not illustrated) within the controller 170 performs audio processing of an audio signal that results from the demultiplexing. To do this, the audio processing unit (not illustrated) includes various decoders.

In addition, the audio processing unit (not illustrated) within the controller 170 performs processing for base, treble, volume adjustment and so on.

The data processing unit (not illustrated) within the controller 170 performs data processing of a data signal that results from the demultiplexing. For example, in a case where a data signal that results from the demultiplexing is a data signal the results from coding, the data signal is decoded. The data signal that results from the coding is an electronic program guide that includes pieces of broadcast information, such as a starting time and an ending time for a broadcast program that will be telecast in each channel.

On the other hand, a block diagram of the controller 170 illustrated in FIG. 3 is a block diagram for an embodiment of the present invention. Each constituent element in the block diagram is subject to integration, addition, or omission according to specifications of the image display controller 170 actually realized.

Particularly, the frame rate converter 350 and the formatter 360 may be provided separately independently of each other or may be separately provided as one module, without being provided within the controller 170.

Figure 4A:
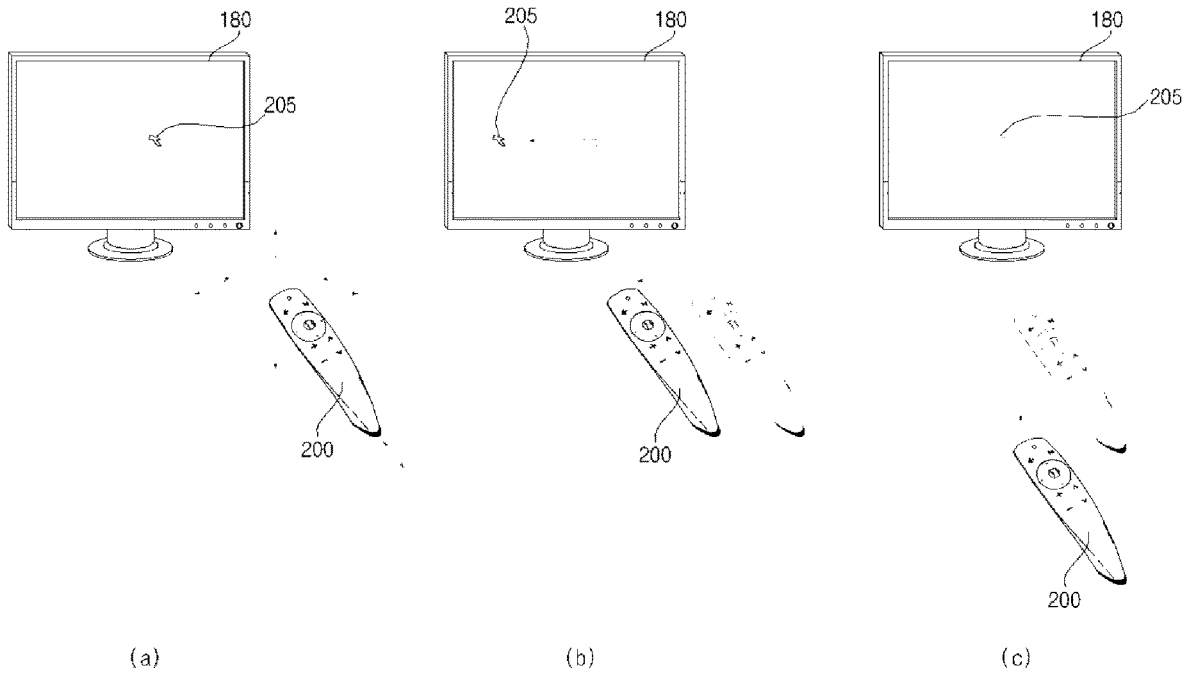
FIG. 4A is a diagram illustrating a method in which a remote controller in FIG. 2 performs control.

FIG. 4A is a diagram illustrating a method in which the remote controller in FIG. 2 performs control.

In FIG. 4A(a), it is illustrated that a pointer 205 which corresponds to the remote controller 200 is displayed on the display 180.

The user moves or rotates the remote controller 200 upward and downward, leftward and rightward (FIG. 4A(b)), and forward and backward (FIG. 4A(c)). The pointer 205 displayed on the display 180 of the image display apparatus corresponds to movement of the remote controller 200. As in the drawings, movement of the pointer 205, which depends on the movement of the remote controller 200 in a 3D space, is displayed and thus, the remote controller 200 is named a spatial remote controller or a 3D pointing device.

FIG. 4A(b) illustrates that, when the user moves the remote controller 200 leftward, the pointer 205 displayed on the display 180 of the image display apparatus correspondingly moves leftward.

Information on the movement of the remote controller 200, which is detected through a sensor of the remote controller 200, is transferred to the image display apparatus. The image display apparatus calculates the information on the movement of the remote controller 200 from coordinates of the pointer 205. The image display apparatus displays the pointer 205 in such a manner that the pointer 25 corresponds to the calculated coordinates.

FIG. 4A(c) illustrates a case where the user moves the remote controller 200 away from the display 180 in a state where a specific button within the remote controller 200 is held down. Accordingly, a selection area within the display 180, which corresponds to the pointer 205, is zoomed in so that the selection area is displayed in an enlarged manner. Conversely, in a case where the user causes the remote controller 200 to approach the display 180, the selection area within the display 180, which corresponds to the pointer 205, is zoomed out so that the selection is displayed in a reduced manner. On the other hand, in a case where the remote controller 200 moves away from the display 180, the selection area may be zoomed out, and in a case where the remote controller 200 approaches the display 180, the selection area may be zoomed in.

On the other hand, an upward or downward movement, or a leftward or rightward movement is not recognized in a state where a specific button within the remote controller 200 is held down. That is, in a case where the remote controller 200 moves away from or approaches the display 180, only a forward or backward movement is set to be recognized without the upward or downward movement, or the leftward or rightward movement being recognized. Only the pointer 205 moves as the remote controller 200 moves upward, downward, leftward, or rightward, in a state where a specific button within the remote controller 200 is not held down.

On the other hand, a moving speed or a moving direction of the pointer 205 corresponds to a moving speed or a moving direction of the remote controller 200, respectively.

Figure 4B:
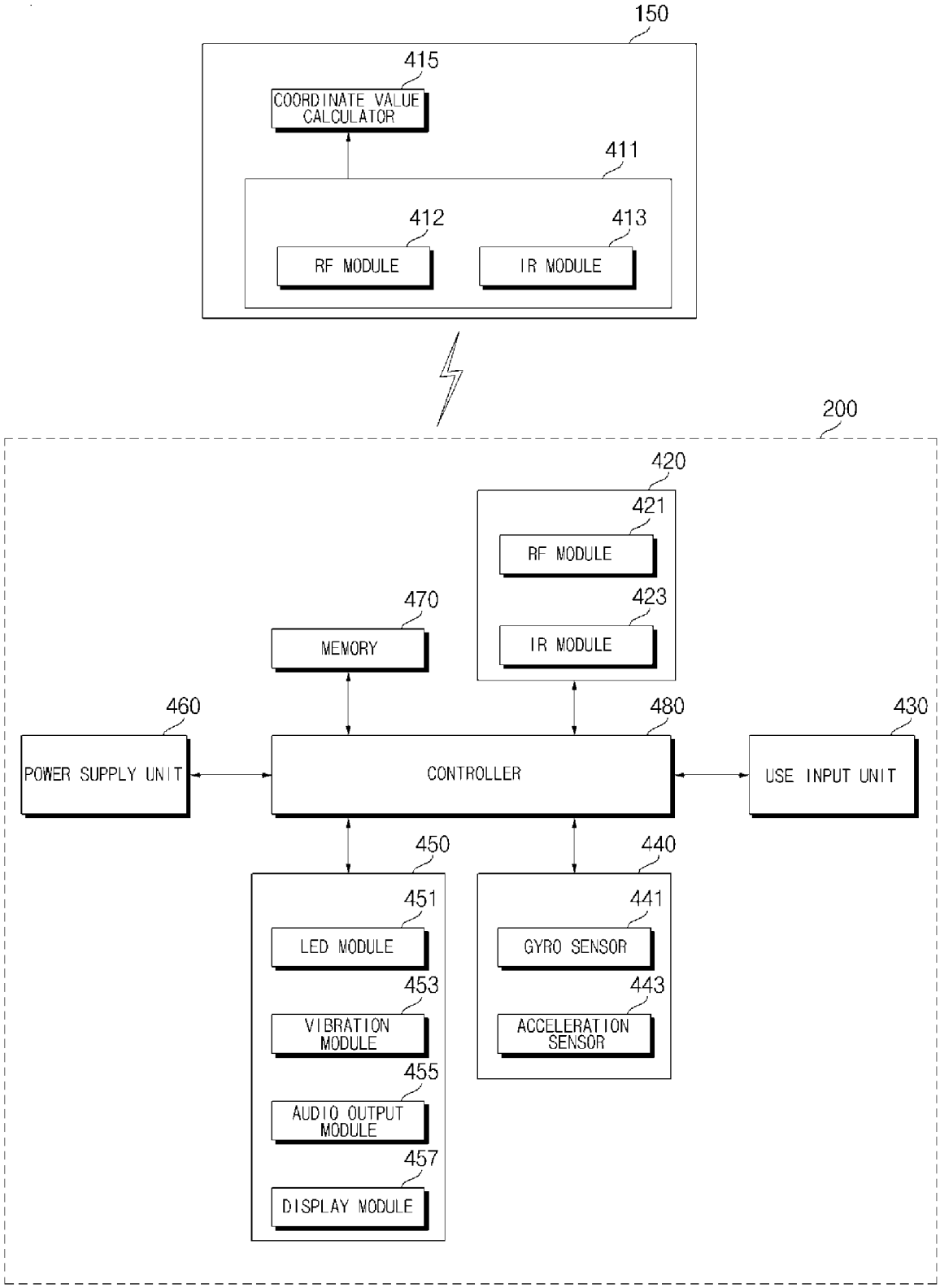
FIG. 4B is a block diagram of the inside of the remote controller in FIG. 2.

FIG. 4B is a block diagram of the inside of the remote controller in FIG. 2.

For description with reference to the drawings, the remote controller 200 includes a wireless communication unit 425, a user input unit 435, a sensor unit 440, an output unit 450, a power supply unit 460, a memory 470, and a controller 480.

The wireless communication unit 425 transmits and receives a signal to and from an arbitrary one of the image display apparatuses according to the embodiments of the present invention, which are described above. Of the image display apparatuses according to the embodiments of the present invention, one image display apparatus is taken as an example for description.

According to the present embodiment, the remote controller 200 includes an RF module 421 that transmits and receives a signal to and from the image display apparatus 100 in compliance with RF communication standards. In addition, the remote controller 200 includes an IR module 423 that possibly transmits and receives a signal to and from the image display apparatus 100 in compliance with IR communication standards.

According to the present embodiment, the remote controller 200 transfers a signal containing information on the movement of the remote controller 200 to the image display apparatus 100 through the RF module 421.

In addition, the remote controller 200 receives a signal transferred by the image display apparatus 100, through the RF module 421. In addition, the remote controller 200 transfers a command relating to power-on, power-off, a channel change, or a volume change, to the image display apparatus 100, through the IR module 423, whenever needed.

The user input unit 435 is configured with a keypad, buttons, a touch pad, a touch screen, or so on. The user inputs a command associated with the image display apparatus 100 into the remote controller 200 by operating the user input unit 435. In a case where the user input unit 435 is equipped with a physical button, the user inputs the command associated with the image display apparatus 100 into the remote controller 200 by performing an operation of pushing down the physical button. In a case where the user input unit 435 is equipped with a touch screen, the user inputs the command associated with the image display apparatus 100 into the remote controller 200 by touching on a virtual key of the touch screen. In addition, the user input unit 435 may be equipped with various types of input means operated by the user, such as a scroll key or a jog key, and the present embodiment does not impose any limitation on the scope of the present invention.

The sensor unit 440 includes a gyro sensor 441 or an acceleration sensor 443. The gyro sensor 441 senses information on the movement of the remote controller 200.

As an example, the gyro sensor 441 senses the information on operation of the remote controller 200 on the x-, y-, and z-axis basis. The acceleration sensor 443 senses information on the moving speed and so on of the remote controller 200. On the other hand, a distance measurement sensor is further included. Accordingly, a distance to the display 180 is sensed.

The output unit 450 outputs an image or an audio signal that corresponds to the operating of the user input unit 435 or corresponds to a signal transferred by the image display apparatus 100. Through the output unit 450, the user recognizes whether or not the user input unit 435 is operated or whether or not the image display apparatus 100 is controlled.

As an example, the output unit 450 includes an LED module 451, a vibration module 453, an audio output module 455, or a display module 457. The LED module 451, the vibration module 453, the audio output module 455, and the display module 457 emits light, generates vibration, outputs audio, or outputs an image, respectively, when the input unit 435 is operated, or a signal is transmitted and received to and from the image display apparatus 100 through a wireless communication unit 425.

The power supply unit 460 supplies a power to the remote controller 200. In a case where the remote controller 200 does not move for a predetermined time, the power supply unit 460 reduces power consumption by interrupting power supply. In a case where a predetermined key provided on the remote controller 200 is operated, the power supply unit 460 resumes the power supply.

Various types of programs, pieces of application data, and so on that are necessary for control or operation of the remote controller 200 are stored in the memory 470. In a case where the remote controller 200 transmits and receives a signal to and from the image display apparatus 100 in a wireless manner through the RF module 421, the signal is transmitted and received in a predetermined frequency band between the remote controller 200 and the image display apparatus 100. The controller 480 of the remote controller 200 stores information on, for example, a frequency band in which data is transmitted and received in a wireless manner to and from the image display apparatus 100 paired with the remote controller 200, in the memory 470, and makes a reference to the stored information.

The controller 480 controls all operations associated with the control by the remote controller 200. The controller 480 transfers a signal that corresponds to operating of a predetermined key of the user input unit 435, or a signal that corresponds to the movement of the remote controller 200, which is sensed in the sensor unit 440, to the image display apparatus 100 through the wireless communication unit 425.

A user input interface 150 of the image display apparatus 100 includes a wireless communication unit 151 that transmits and receives a signal in a wireless manner to and from the remote controller 200, and a coordinate value calculator 415 that calculates a coordinate value of the pointer, which corresponds to the operation of the remote controller 200.

The user input interface 150 transmits and receives the signal in a wireless manner to and from the remote controller 200 through the RF module 421. In addition, a signal transferred in compliance with the IR communication standards by the remote controller 200 through the IR module 423 is received.

The coordinate value calculator 415 calculates a coordinate value (x, y) of the pointer 205 to be displayed on the display 180, which results from compensating for a hand movement or an error, from a signal that corresponds to the operation of the remote controller 200, which is received through the wireless communication unit 151.

A transfer signal of the remote controller 200, which is input into the image display apparatus 100 through the user input interface 150 is transferred to the controller 170 of the image display apparatus 100. The controller 170 determines information on the operation of the remote controller 200 and information on operating of a key, from the signal transferred by the remote controller 200, and correspondingly controls the image display apparatus 100.

As another example, the remote controller 200 calculates a coordinate value of a pointer, which corresponds to the operation of the remote controller 200, and outputs the calculated value to the user input interface 150 of the image display apparatus 100. In this case, the user input interface 150 of the image display apparatus 100 transfers information on the received coordinate values of the pointer, to the controller 170, without performing a process of compensating for the hand movement and the error.

In addition, as another example, unlike in the drawings, it is also possible that the coordinate value calculator 415 is included within the controller 170 instead of the user input interface 150.

Figure 5:
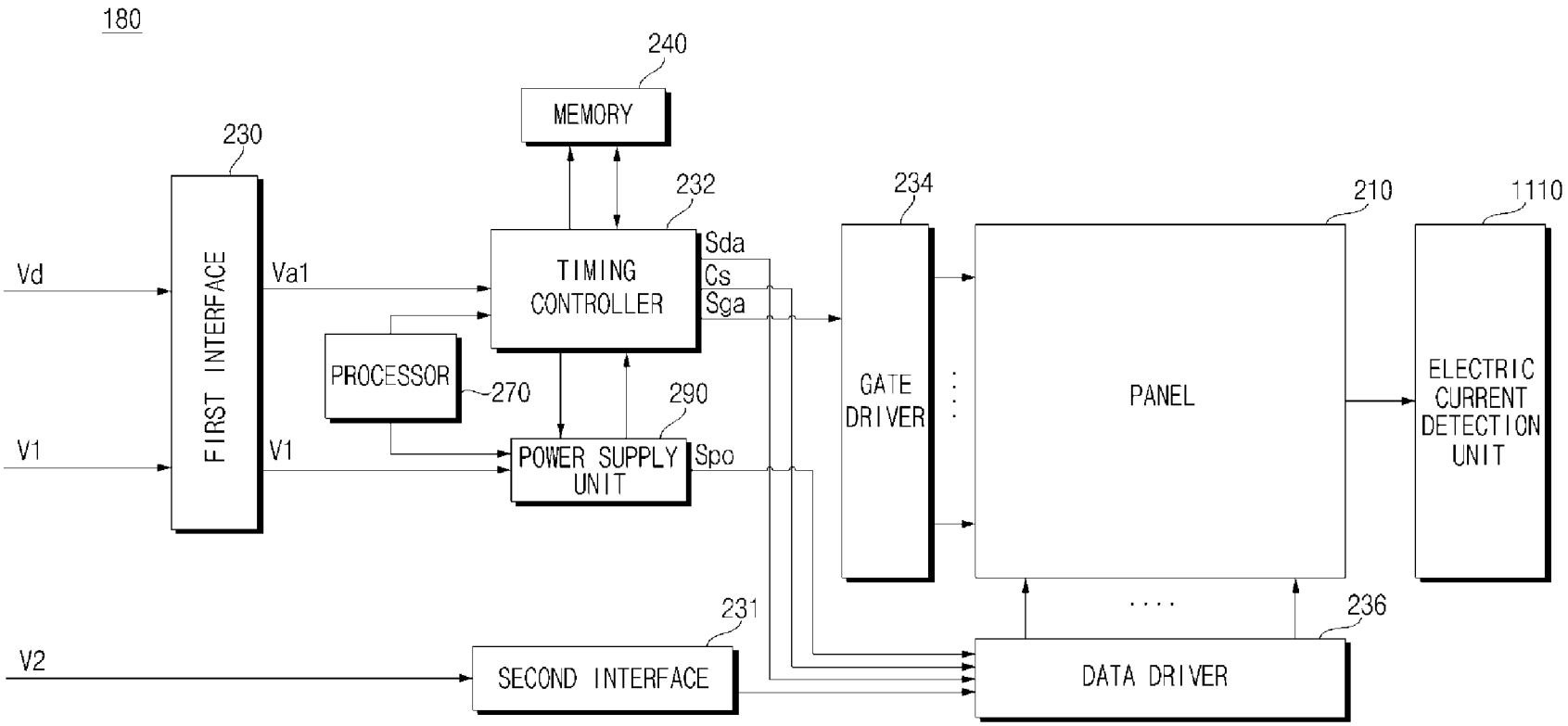
FIG. 5 is a block diagram of the inside of a display in FIG. 2.

FIG. 5 is a block diagram of the inside of the display in FIG. 2.

With reference with the drawings, the display 180 based on the organic light-emitting diode may include the OLED panel 210, a first interface 230, a second interface 231, a timing controller 232, a gate driver 234, a data driver 236, a memory 240, a processor 270, a power supply unit 290, an electric current detection unit 1110, and so on.

The display 180 receives an image signal Vd, a first direct current power V1, and a second direct current power V2. Based on the image signal Vd, the display 180 display a predetermined image is displayed.

On the other hand, the first interface 230 within the display 180 receives the image signal Vd and the first direct current power V1 from the controller 170.

At this point, the first direct current power V1 is used for operation for each of the power supply unit 290 and the timing controller 232 within the display 180.

Next, the second interface 231 receives the second direct current power V2 from the external power supply unit 190. On the other hand, the second direct current power V2 is input into the data driver 236 within the display 180.

Based on the image signal Vd, the timing controller 232 outputs a data drive signal Sda and a gate drive signal Sga.

For example, in a case where the first interface 230 converts the image signal Vd input, and outputs image signal va1 that results from the conversion, the timing controller 232 outputs the data drive signal Sda and the gate drive signal Sga based on the image signal va1 that results from the conversion.

The timing controller 232 further receives a control signal, the vertical synchronization signal Vsync, and so on, in addition to a video signal Vd from the controller 170.

The timing controller 232 outputs the gate drive signal Sga for operation of the gate driver 234 and the data drive signal Sda for operation of the data driver 236, based on the control signal, the vertical synchronization signal Vsync, and so on in addition to the video signal Vd.

In a case where the OLED panel 210 includes a subpixel for RGBW, the data drive signal Sda at this time is a data drive signal for a subpixel for RGBW.

On the other hand, the timing controller 232 further outputs a control signal Cs to the gate driver 234.

The gate driver 234 and the data driver 236 supplies a scanning signal and an image signal to the OLED panel 210 through a gate line GL and a data line DL according to the gate drive signal Sga and the data drive signal Sda, respectively, from the timing controller 232. Accordingly, a predetermined image is displayed on the OLED panel 210.

On the other hand, the OLED panel 210 includes an organic light-emitting layer. In order to display an image, many gate lines GL and many data lines DL are arranged to intersect each other in a matrix form, at each pixel that corresponds to the organic light-emitting layer.

On the other hand, the data driver 236 outputs a data signal to the OLED panel 210 based on the second direct current power V2 from the second interface 231.

The power supply unit 290 supplies various types of powers to the gate driver 234, the data driver 236, the timing controller 232, and so on.

The electric current detection unit 1110 detects an electric current that flows through a subpixel of the OLED panel 210. The electric current detected is input into the processor 270 and or so for accumulated electric-current computation.

The processor 270 performs various types of control within the display 180. For example, the gate driver 234, the data driver 236, the timing controller 232, and so on are controlled.

On the other hand, the processor 270 receives information of the electric current that flows through the subpixel of the OLED panel 210, from the electric current detection unit 1110.

Then, based on the information of the electric current that flows through the subpixel of the OLED panel 210, the processor 270 computes an accumulated electric current of a subpixel of each organic light-emitting diode (OLED) panel 210. The accumulated electric current computed is stored in the memory 240.

On the other hand, in a case where the accumulated electric current of the subpixel of each organic light-emitting diode (OLED) panel 210 is equal to or greater than an allowed value, the processor 270 determines the subpixel as a burn-in subpixel.

For example, in a case where the accumulated electric current of the subpixel of each organic light-emitting diode (OLED) panel 210 is 300000 A or higher, the subpixel is determined as a burn-in subpixel.

On the other hand, in a case where, among subpixels of each organic light-emitting diode (OLED) panel 210, an accumulated electric current of one subpixel approaches the allowed value, the processor 270 determines the one subpixel as expected to be a burn-in subpixel.

On the other hand, based on the electric current detected in the electric current detection unit 1110, the processor 270 determines a subpixel that has the highest accumulated electric current, as expected to be a burn-in subpixel.

Figure 6A:
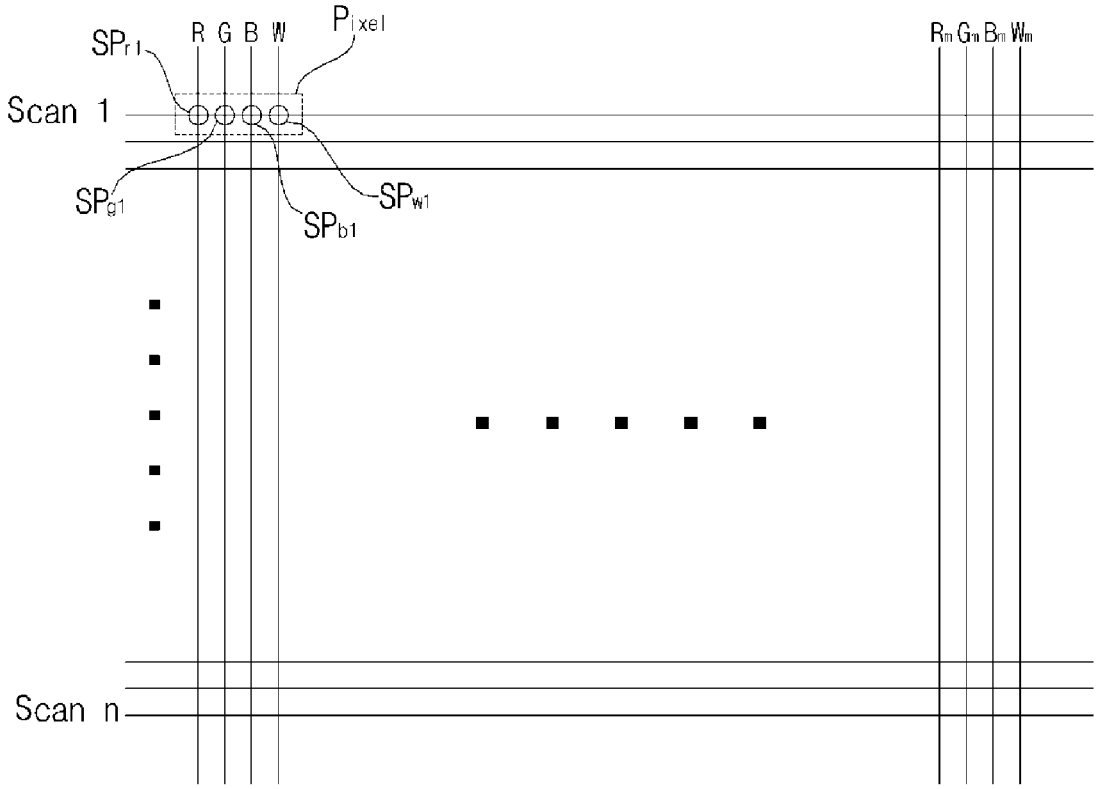
FIGS. 6A and 6B are diagrams that are referred to for description of an organic light-emitting diode (OLED) panel in FIG. 5.
Figure 6B:
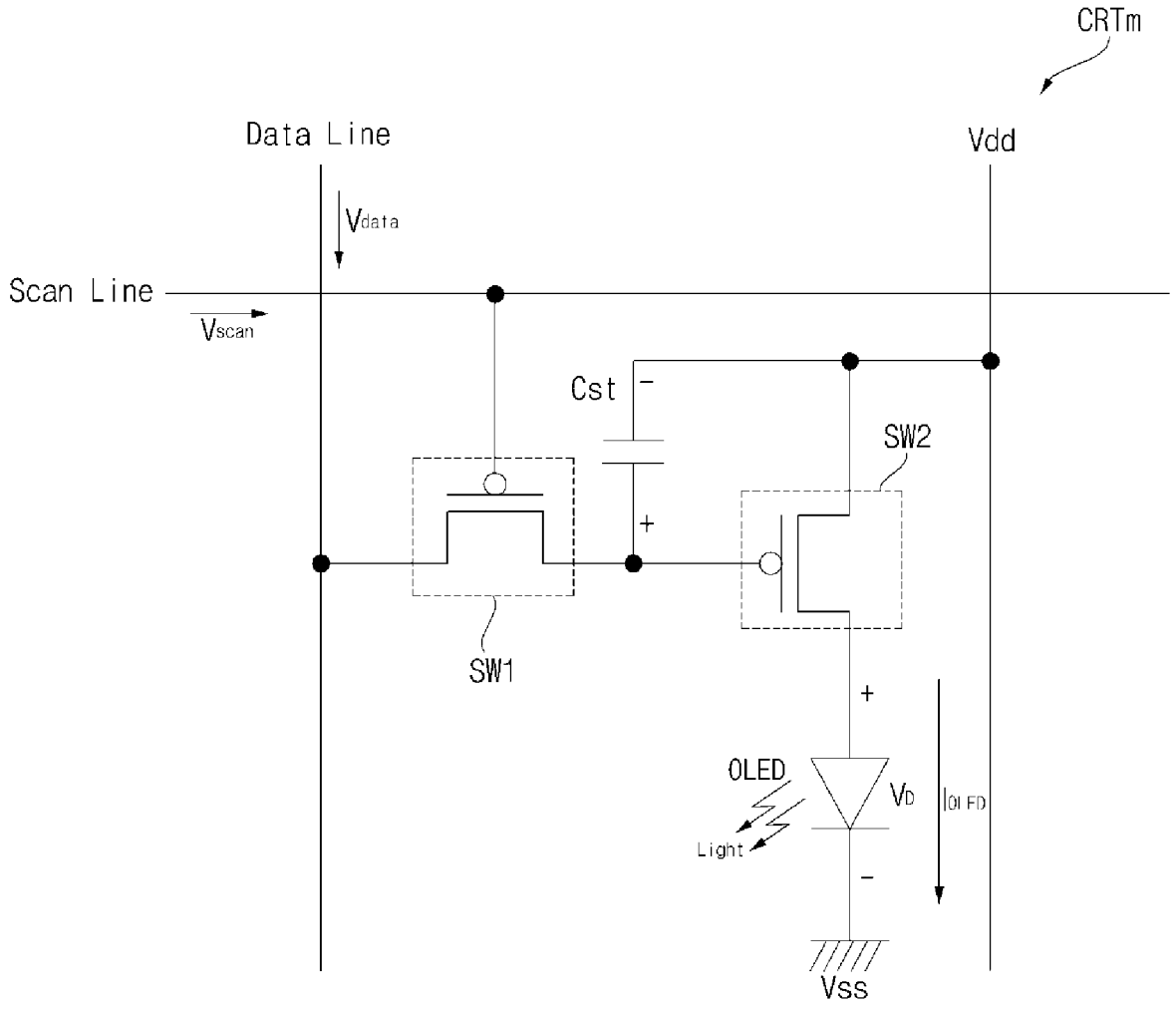

FIGS. 6A and 6B are diagrams that are referred to for description of the OLED panel in FIG. 5.

First, FIG. 6A is a diagram illustrating a pixel within the OLED panel 210.

With reference to the drawings, the OLED panel 210 includes a plurality of scan lines Scan 1 to Scan n and a plurality of data lines R1, G1, B1, W1 to Rm, Gm, Bm, Wm that intersect a plurality of scan lines Scan 1 to Scan n, respectively.

On the other hand, an area where the scan line and the data line within the OLED panel 210 intersect each other is defined as a subpixel. In the drawings, a pixel that includes a subpixel SR1, SG1, SB1, SW1 for RGBW is illustrated.

FIG. 6B illustrates a circuit of one subpixel within the OLED panel in FIG. 6A.

With reference to the drawings, an organic light-emitting subpixel circuit CRTm includes a switching element SW1, a storage capacitor Cst, a drive switching element SW2, and an organic light-emitting layer (OLED), which are active-type elements.

A scan line is connected to a gate terminal of the scan switching element SW1. The scanning switching element SW1 is turned on according to a scan signal Vdscan input. In a case where the scan switching element SW1 is turned on, a data signal Vdata input is transferred to the gate terminal of the scan switching element SW2 or one terminal of the storage capacitor Cst.

The storage capacitor Cst is formed between the gate terminal and a source terminal of the drive switching element SW2. A predetermined difference between a data signal level transferred to one terminal of the storage capacitor Cst and a direct current (VDD) level transferred to the other terminal of the storage capacitor Cst is stored in the storage capacitor Cst.

For example, in a case where data signals have different levels according to a pulse amplitude modulation (PAM) scheme, power levels that are stored in the storage capacitor Cst are different according to a difference between levels of data signals Vdata.

As another example, in a case where data signals have different pulse widths according to a pulse width modulation (PWM) scheme, power levels that are stored in the storage capacitor Cst are different according to a difference between pulse widths of data signals Vdata.

The drive switching element SW2 is turned on according to the power level stored in the storage capacitor Cst. In a case where the drive switching element SW2 is turned on, a drive electric current (IOLED), which is in proportion to the stored power level, flows through the organic light-emitting layer (OLED). Accordingly, the organic light-emitting layer (OLED) performs a light-emitting operation.

The organic light-emitting layer (OLED) includes a light-emitting layer (EML) for RGBW, which corresponds to a subpixel, and includes at least one of the following layers: a hole implementation layer (HIL), a hole transportation layer (HTL), an electron transportation layer (ETL), and an electron implementation layer (EIL). In addition to these, the organic light-emitting layer includes a hole support layer and so on.

On the other hand, when it comes to a subpixel, the organic light-emitting layer outputs while light, but in the case of the subpixels for green, red, and blue, a separate color filter is provided in order to realize color. That is, in the case of the subpixels for green, red, and blue, color filters for green, red, and blue, respectively, are further provided. On the other hand, in the case of the subpixel for white, white light is output and thus a separate color filter is unnecessary.

On the other hand, in the drawings, as the scan switching element SW1 and the drive switching element SW2, p-type MOSFETs are illustrated, but it is also possible that n-type MOSFETs, or switching elements, such as JETs, IGBTs, or SICs, are used.

On the other hand, a pixel is a hold-type element to which a scan signal is applied during a unit display duration, specifically, during a unit frame, and of which the organic light-emitting layer (OLED) then continues to emit light.

Accordingly, as described above, the phenomenon where an image leaves a trail occurs when displaying the moving image. It is assumed that a method of solving this problem is to display a black image between frame images. The detail of this will be described below with reference to FIG. 3 and subsequent figures.

Figure 7:
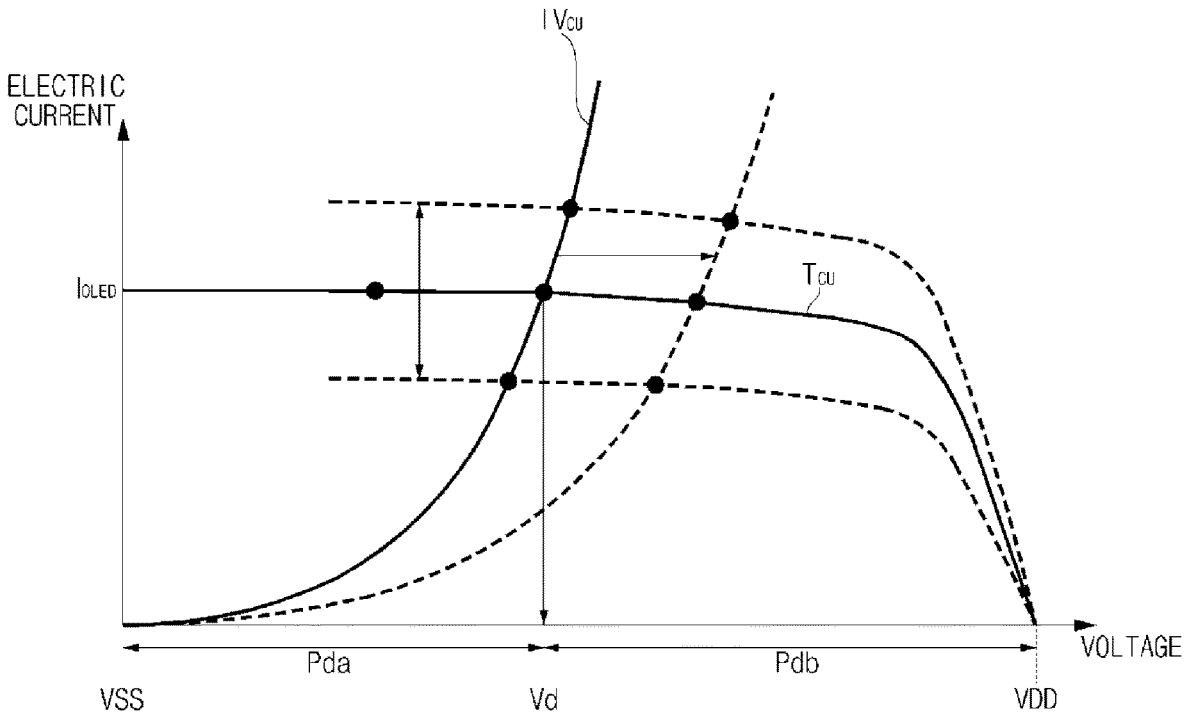
FIG. 7 is a diagram illustrating characteristics of a voltage and an electric current of the organic light-emitting layer in FIG. 6B.

FIG. 7 is a diagram illustrating characteristics of a voltage and an electric current of the organic light-emitting layer in FIG. 6B.

With reference to the drawings, IVcu is a curved line indicating the characteristics of the electric current and the voltage of the organic light-emitting layer (OLED), and Tcu is a curved line indicating characteristics of an electric current and a voltage of the drive switching element SW2.

In a case where a second voltage Vss is applied to the cathode of the organic light-emitting layer (OLED), a voltage of Vss+Vd that results from adding a voltage of Vd to the second voltage Vss has to be applied to the anode of the organic light-emitting layer (OLED).

On the other hand, the first voltage VDD is applied, as an operating voltage, to the drive switching element SW2.

On the other hand, a section PDda between VSS and Vd is a section for an operating voltage of the organic light-emitting layer (OLED), and a section PDdb between Vd to VDD corresponds to a section for the operating voltage of the drive switching element SW2.

On the other hand, with switching operation of the drive switching element SW2, the electric current IOLED that flows through the organic light-emitting layer (OLED) is computed using Equation 1 that follows.

$$I_{OLED} = \frac{1}{2} \cdot \frac{W}{L} \cdot \mu \cdot C_{SINx} \cdot (V_{DATA} - V_{DD} - V_{TH})^2 \quad \text{Equation 1}$$

where W denotes the width of a channel of a switching element, L denotes the length of the channel of the switching element, p denotes the permittivity of the channel, C sin x denotes a capacitance of the switching element, Vdata denotes a voltage applied through the data line, VDD denotes an operating voltage, and Vth denotes a critical voltage of the switching element.

From FIG. 7, it is understood that as Vth decreases or p increase, a Tcu curve moves upward and that as Vth increases or p decreases, the Tcu curve moves downward.

On the other hand, from FIG. 7, it is understood that as a threshold voltage of the organic light-emitting layer (OLED) increases, IVcu moves rightward.

On the other hand, the more a frequency of a vertical synchronization signal Vsync for displaying an image is increased, that is, the more a frame frequency increases, the more a speed at which the drive switching element SW2 has to be performed is increased.

The more the speed at which the drive switching element SW2 is performed is increased, the more frequently the above-described phenomenon where an image leaves a trail occurs. Accordingly, a black frame is preferably displayed when displaying an image frame.

Figure 8:
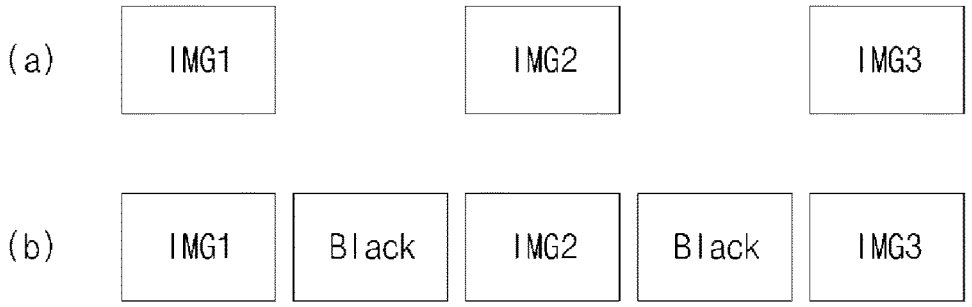
FIG. 8 is a diagram illustrating a method of displaying an image according to an embodiment of the present invention.

FIG. 8 is a diagram illustrating a method of displaying an image according to an embodiment of the present invention.

With reference to the drawings, FIG. 8A illustrates that frame images IMG1, IMG2, and IMG3 are displayed at a frequency of 120 Hz.

In a case where the frame images IMG1, IMG2, and IMG3 are associated with a moving image instead of a still image, the phenomenon where an image leaves a trail occurs in the case of FIG. 8A.

On the other hand, FIG. 8B illustrates that the black image is inserted between each of the IMG1, IMG2, and IMG3. Accordingly, an effect in which the operating is performed at a frequency of 240 Hz instead of 120 Hz appears, and an effect of preventing the phenomenon where an image leaves a trail is achieved.

On the other hand, the black image display in FIG. 8B is simply realized as in the following method in FIG. 9.

Figure 9:
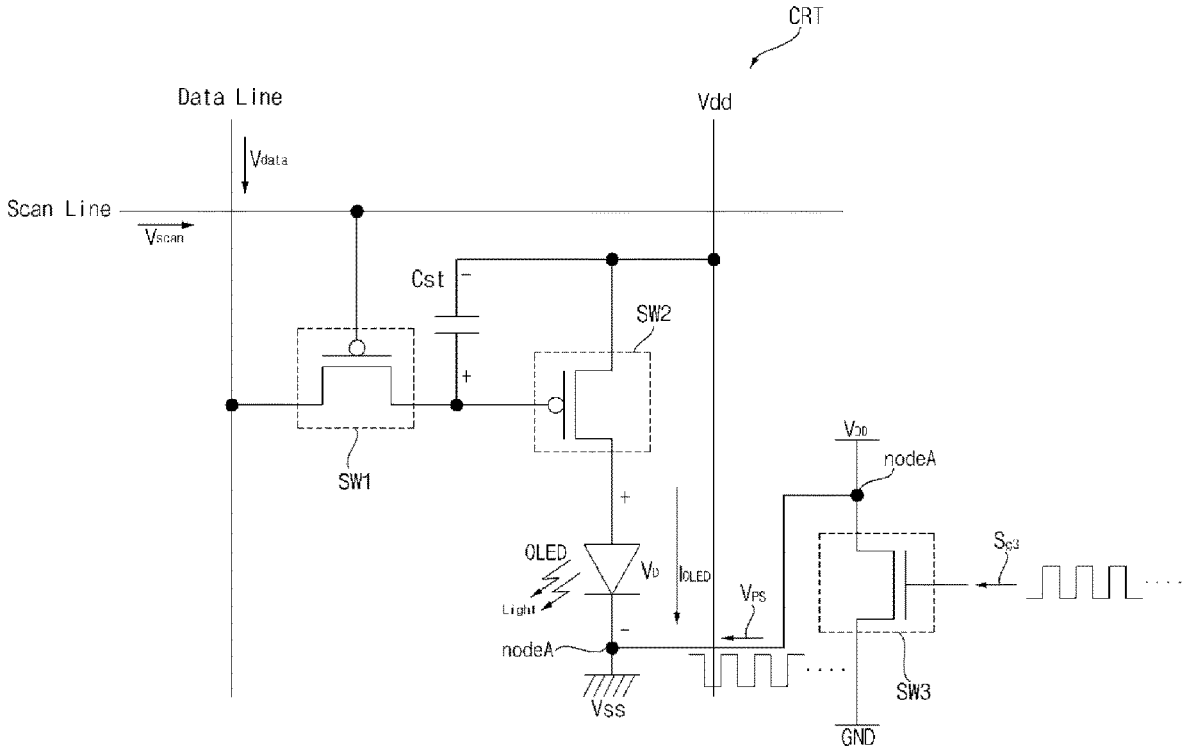
FIG. 9 is a diagram illustrating a pixel circuit according to an embodiment of the present invention.
Figure 10:
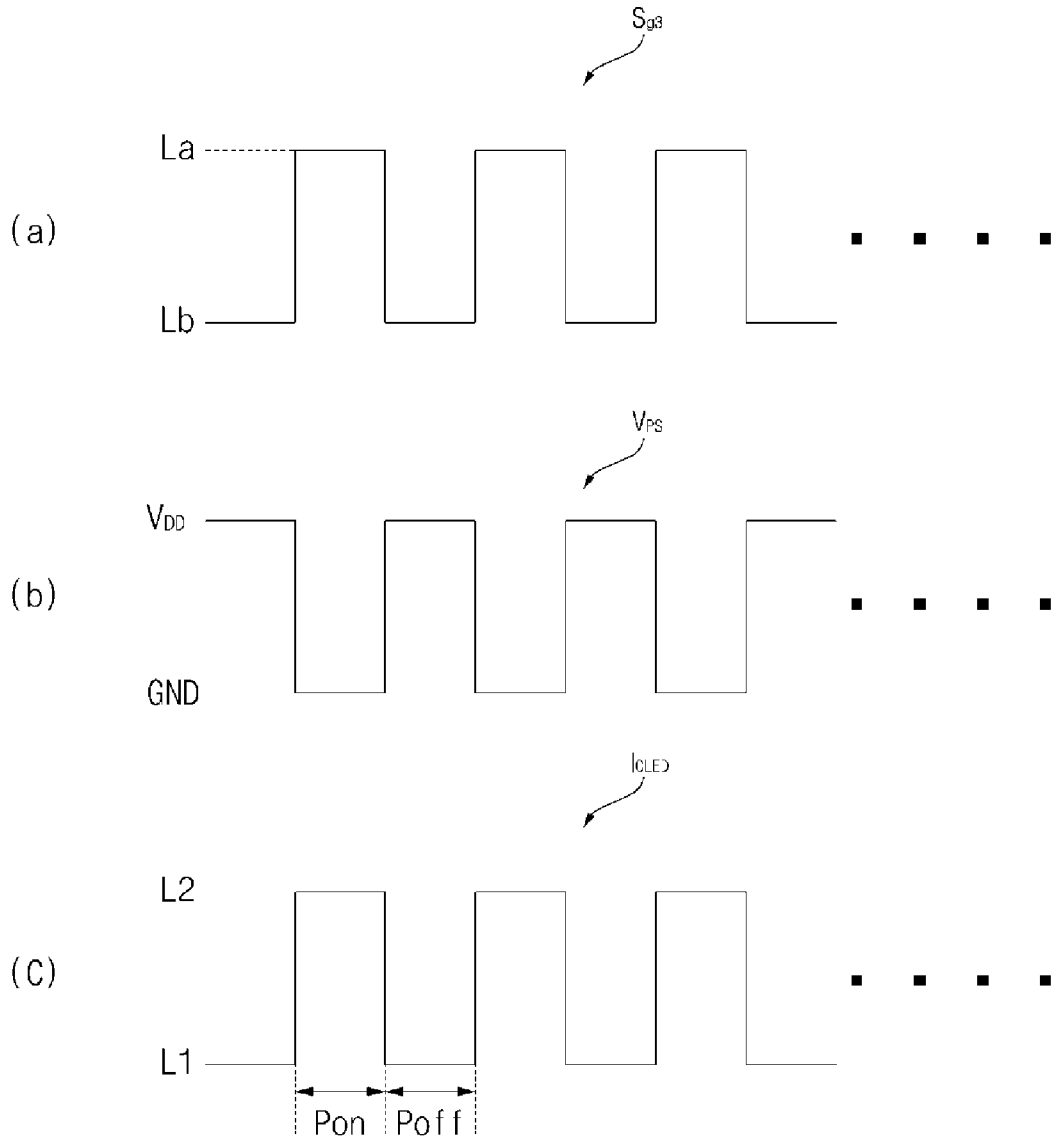
FIG. 10 is a diagram illustrating a signal waveform of the pixel circuit in FIG. 9.

FIG. 9 is a diagram illustrating a pixel circuit according to an embodiment of the present invention. FIG. 10 is a diagram illustrating each signal waveform of the pixel circuit in FIG. 9.

FIG. 9 illustrates a circuit of one subpixel within the OLED panel in FIG. 6A.

With reference to the drawings, a pixel circuit CRT within the organic light-emitting subpixel includes the switching element SW1, the storage capacitor Cst, the drive switching element SW2, the organic light-emitting layer (OLED), and the first switching element SW3, which are active-type elements.

The scan line is connected to the gate terminal of the scan switching element SW1. The scanning switching element SW1 is turned on according to the scan signal Vdscan input. In the case where the scan switching element SW1 is turned on, the data signal Vdata input is transferred to the gate terminal of the scan switching element SW2 or one terminal of the storage capacitor Cst.

The storage capacitor Cst is formed between the gate terminal and the source terminal of the drive switching element SW2. A predetermined difference between the data signal level transferred to one terminal of the storage capacitor Cst and the direct current (VDD) level transferred to the other terminal of the storage capacitor Cst is stored in the storage capacitor Cst.

For example, in the case where the data signals have different levels according to the pulse amplitude modulation (PAM) scheme, the power levels that are stored in the storage capacitor Cst are different according to the difference between the levels of the data signals Vdata.

As another example, in the case where data signals have different pulse widths according to the pulse width modulation (PWM) scheme, the power levels that are stored in the storage capacitor Cst are different according to the difference between the pulse widths of the data signals Vdata.

The drive switching element SW2 is turned on according to the power level stored in the storage capacitor Cst. In the case where the drive switching element SW2 is turned on, the drive electric current (IOLED), which is in proportion to the stored power level, flows through the organic light-emitting layer (OLED). Accordingly, the organic light-emitting layer (OLED) performs the light-emitting operation.

The organic light-emitting layer (OLED) includes the light-emitting layer (EML) for RGBW, which corresponds to a subpixel, and includes at least one of the following layers: the hole implementation layer (HIL), the hole transportation layer (HTL), the electron transportation layer (ETL), and the electron implementation layer (EIL). In addition to these, the organic light-emitting layer includes the hole support layer and so on.

On the other hand, in the drawings, as the scan switching element SW1 and the drive switching element SW2, p-type MOSFETs are illustrated, but it is also possible that n-type MOSFETs, or switching elements, such as JETs, IGBTs, or SICs, are used.

On the other hand, the organic light-emitting layer (OLED), when modeled on an electric circuit, is modeled as having an anode and a cathode, similarly to a diode.

In the drawings, it is illustrated that the anode of the organic light-emitting layer (OLED) is connected to the drive switching element SW2, and that the pulse voltage Vps is applied to the cathode of the organic light-emitting layer (OLED).

That is, a difference lies in the fact that the pulse voltage Vps that has a high level and a low level is applied to the cathode of the organic light-emitting layer (OLED), instead of the second voltage Vss being applied to the cathode of the organic light-emitting layer (OLED).

To do this, the pixel circuit CRT according to an embodiment of the present embodiment includes the first switching element SW3 connected between the cathode of the organic light-emitting layer (OLED) and the ground GND.

A pulse signal Sg3 that has a high level La and a row level Lb, as illustrated in FIG. 10A, is applied to a gate terminal of the first switching element SW3, and the first voltage VDD and the ground voltage GND are applied between both terminals (a source and a drain) of the first switching element SW3.

According to the high level La of the pulse signal applied to the gate terminal of the first switching element SW3, the first switching element SW3 is turned on. According to the low level Lb, the first switching element SW3 is turned on.

In addition, according to the low level Lb of the pulse signal instead applied to the gate terminal of the first switching element SW3, the first switching element SW3 is turned on. According to the high level La, the first switching element SW3 is turned off.

On the other hand, with the turning-on of the first switching element SW3, as illustrated in FIG. 10B, the pulse voltage Vps has a high level VDD, and with the turning-off of the first switching element SW3, as illustrated in FIG. 10B, the pulse voltage Vps has a low-level GND.

On the other hand, in a case where the pulse voltage Vps has the high level VDD, although the pulse voltage Vps is a gate signal, the drive switching element SW2 is turned off, and in a case where the pulse voltage Vps has the low level GND, the drive switching element SW2 is turned off according to the gate signal.

That is, in a case where the pulse voltage Vps has the high level VDD, as illustrated in FIG. 10C, the electric current IOLED that flows through the organic light-emitting layer (OLED) has a low level L1, and in a case where the pulse voltage Vps has the low level GND, as illustrated in FIG. 10C, the electric current IOLED that flows through the organic light-emitting layer (OLED) has a high level L2.

In the end, the electric current IOLED that flows through the organic light-emitting layer (OLED) corresponds to the pulse signal Sg3, and has a characteristic opposite to that of the pulse voltage Vps.

Accordingly, according to the present invention, in a case where the moving image to be displayed on the OLED panel 210 is a moving image, where an amount of movement of an object within the moving image is equal to or greater than a predetermined value, and thus where the panel response time adjustment is necessary, with the repetitive switching by the first switching element SW3, the pulse voltage Vps is set to be applied to the cathode of the organic light-emitting layer (OLED).

Particularly, the first switching element SW3 performs synchronization switching in such a manner that during a frame image display duration, the pulse voltage Vps has the low level GND in order for an electric current to flow through the organic light-emitting layer (OLED) and in such a manner that during a black image display duration, the pulse voltage Vps has the high level VDD in order for an electric current not to flow through the organic light-emitting layer (OLED). Accordingly, the panel (210) response speed is improved when displaying the moving image.

In addition, a pulse signal is generated in such a manner that during the frame image display duration, the pulse signal Sg3 has the high level La in order for an electric current to flow through the organic light-emitting layer (OLED) and in such a manner that during the black image display duration, the pulse signal Sg3 has the low level Lb in order for an electric current not to flow through the organic light-emitting layer (OLED). Accordingly, the panel (210) response speed is improved when displaying the moving image.

On the other hand, according to the present invention, in a case where the panel response time adjustment is unnecessary, the first switching element SW3 is turned off, and thus the second voltage Vss that has a fixed level is set to be applied to the cathode of the organic light-emitting layer (OLED).

Figure 11A:
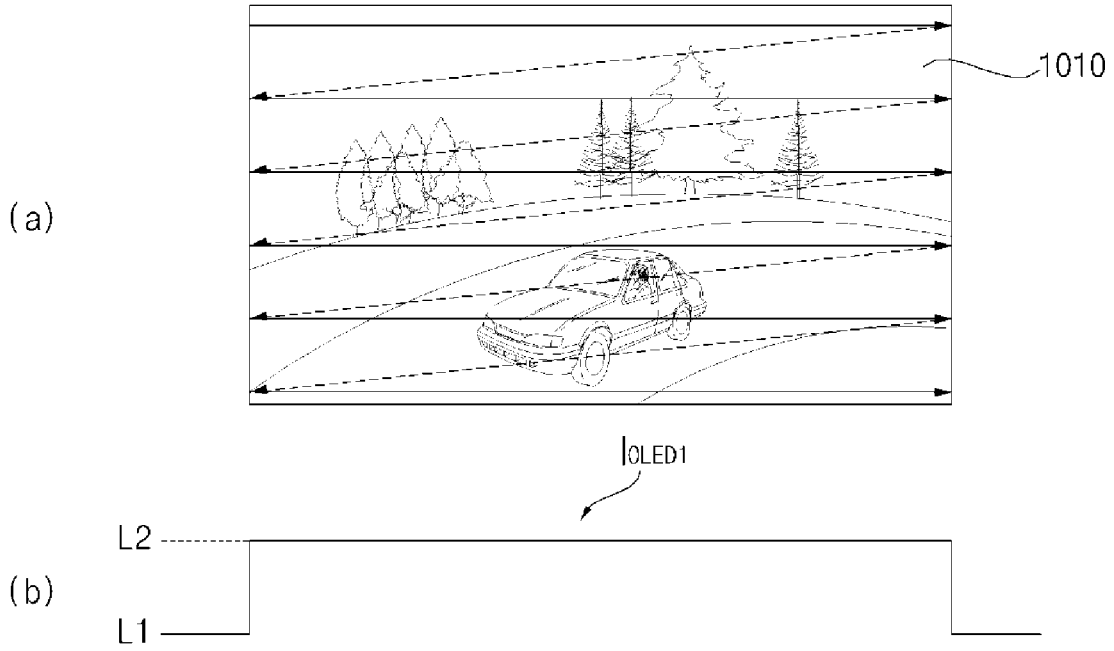
FIG. 11A is a diagram illustrating a method of displaying an image in a normal mode.

FIG. 11A is a diagram illustrating a method of displaying an image in a normal mode.

With reference to the drawings, in the normal mode in which the panel response time adjustment is unnecessary, during the frame image display duration, an electric current IOLED1 that flows through the organic light-emitting layer (OLED) is set to have the high level L2.

To do this, during the frame image display duration, the first switching element SW3 in FIG. 9 is turned off and thus the second voltage Vss that has a fixed level is set to be applied to the cathode of the organic light-emitting layer (OLED).

Figure 11B:
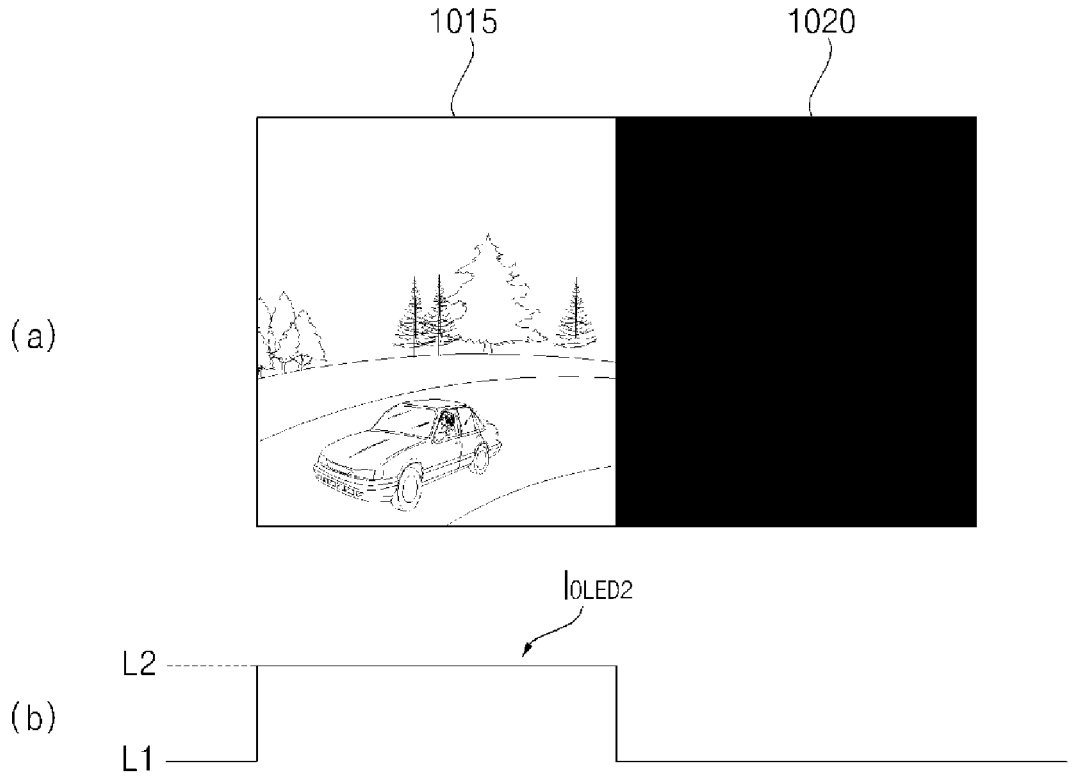
FIG. 11B is a diagram illustrating a method of displaying an image in a panel response time adjustment mode according to an embodiment of the present invention.

FIG. 11B is a diagram illustrating a method of displaying an image in a panel response time adjustment mode according to an embodiment of the present invention.

With reference to the drawings, in the case of the panel response time adjustment mode in which the panel response time adjustment is necessary, during the frame image display duration, the electric current IOLED1 that flows through the organic light-emitting layer (OLED) is set to have the high level L2 and the low level L1 sequentially in order to display a frame image 1015 and a black image 1020.

That is, during a portion of the frame image display duration, the electric current IOLED1 that flows through the organic light-emitting layer (OLED) is set to have the high level L2 and during the remaining portions, the electric current IOLED1 that flows through the organic light-emitting layer (OLED) is set to have the low level L1.

To do this, the first switching element SW3 is preferably performed in such a manner that during a portion of the frame image display duration, the pulse voltage Vps has the low level GND and in such a manner that during the remaining portions, the pulse voltage Vps has the high level VDD.

In addition, a pulse signal is preferably generated in such a manner that during a portion of the frame image display duration, the pulse signal Sg3 has the high level La and in such a manner that during the remaining portions, the pulse signal Sg3 has the row level Lb.

Figure 12A:
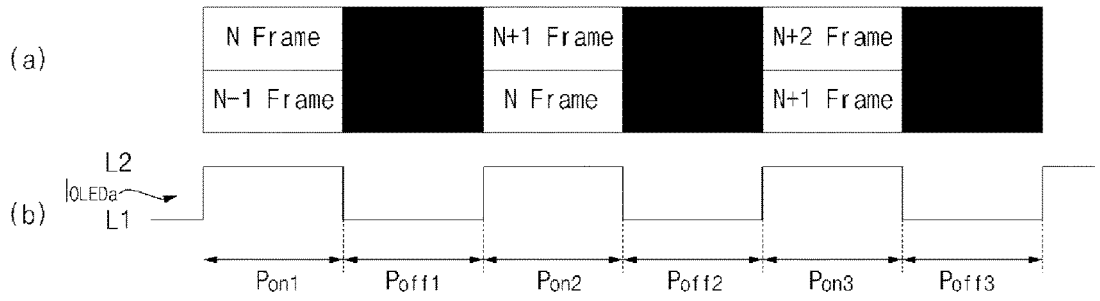
FIGS. 12A to 12C are diagrams that illustrate different examples, respectively, of the method of displaying an image.
Figure 12B:
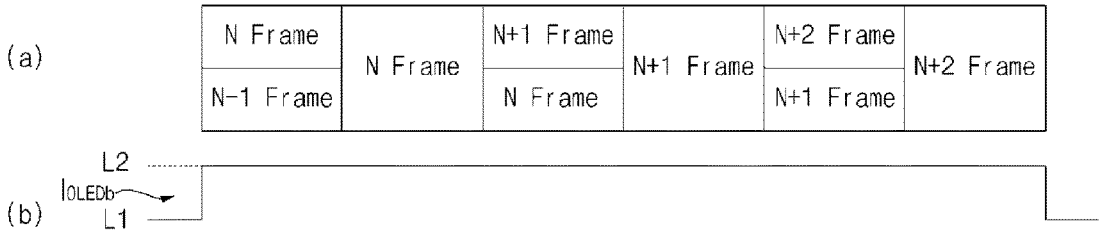
Figure 12C:
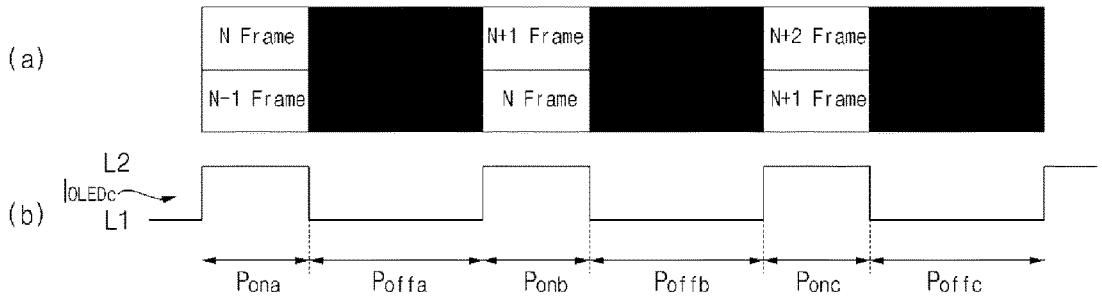

FIGS. 12A to 12C are diagrams that illustrate different examples, respectively, of the method of displaying an image.

First, FIG. 12A is a diagram illustrating an example of image display in the panel response time adjustment mode.

With reference to the drawings, in a case where the moving image to be displayed on the OLED panel 210 is a moving image, the display 180 enters the panel response time adjustment mode, and the display displays an image.

More specifically, in a case where the moving image to be displayed on the OLED panel 210 is the moving image and where an amount of movement of an object within the moving image is equal to or greater than the predetermined value, the controller 170 or 232 may be configured to enter the panel response time adjustment mode, and accordingly, the display 180 displays an image according to the panel response time adjustment mode.

To do this, electric current IOLEDa that flows through the organic light-emitting layer (OLED) preferably has the high level L2 and the low level L1 alternately.

During a first duration Pon1, the display 180 displays a portion of the first frame (n frames) image on the first area of the OLED panel 210, and displays a portion of the second frame (n−1 frames) image before the first frame (n frames) image on the second area other than the first area of the OLED panel 210. During a second duration Poff1 after the first duration Pon1, the display 180 displays the black image on all display areas of the OLED panel 210.

That is, during the first duration Pon1 during which the drive switching element SW2 is turned on, the display 180 displays a portion of the first frame (n frames) image on the first area of the OLED panel 210, and displays a portion of the second frame (n−1 frames) image before the first frame (n frames) image on the second area other than the first area of the OLED panel 210. During the second duration Poff1 during which the drive switching element SW2 is turned off, the display 180 displays the black image on all display areas of the OLED panel 210.

At this point, the first area corresponds to an upper area of the upper portion of the OLED panel 210, and the second area corresponds to a lower area of the OLED panel 210.

On the other hand, during the first duration Pon1, another portion of the first frame image is stored in the storage capacitor Cst is stored in the storage capacitor Cst.

At this point, a portion of the first frame (n frames) image is an image that corresponds to the upper area of the OLED panel 210, and another portion of the first frame (n frames) image is an image that corresponds to the lower area of the OLED panel 210.

Accordingly, during a third duration Pon2 after the second duration Poff1, the display 180 displays a third frame (n+1 frames) image after the first frame (n frames) image on the first area of the OLED panel 210, and displays another portion of the first frame (n frames) image stored in the storage capacitor Cst on the second area of the OLED panel 210.

Then, during a fourth duration Poff2 after the third duration Pon2, the display 180 displays the black image on all display areas of the OLED panel 210.

On the other hand, the display 180 in FIG. 12A is described differently than above. That is, in a case where the panel response time adjustment is necessary, during the first duration Pon1, the display 180 displays a portion of the n frame image on the upper portion of the OLED panel 210, and displays a portion of the n−1 frame image on the lower portion of the OLED panel 210. During the second duration Poff1 after the first duration Pon1, the display 180 displays the black image on all display areas of the OLED panel 210.

On the other hand, during the third duration Pon2 after the second duration Poff1, the display 180 displays a portion of an n+1 frame image on the upper portion of the OLED panel 210, and displays another portion of the n frame image on the lower portion of the OLED panel 210. During a fourth duration Poff2 after the third duration Pon2, the display 180 displays the black image on all display areas of the OLED panel 210.

At this point, during the first duration Pon1, another portion of the n frame image is stored in the storage capacitor Cst, and during the third duration Pon2, another portion of the n frame image stored in the storage capacitor Cst is stored is displayed on the lower portion of the OLED panel 210.

On the other hand, during a fifth duration Pon3 after the fourth duration Poff3, the display 180 displays a portion of a n+2 frame on the upper portion of the OLED panel 210, and displays another portion of the n+1 frame image on the lower portion of the OLED panel 210. During a sixth duration Poff3 after the fifth duration Pon3, the display 180 displays the black image on all display areas of the OLED panel 210.

At this time, during the third duration Pon2, another portion of the n+1 frame image is stored in the storage capacitor Cst, and during the fifth duration Pon3, another portion of the n+1 frame image stored in the storage capacitor Cst is displayed on the lower portion of the OLED panel 210.

Next, FIG. 12B is a diagram illustrating an example of the image display in the normal mode.

With reference to the drawings, in a case where the moving image to be displayed on the OLED panel 210 is not the moving image or in a case where the moving image to be displayed on the OLED panel 210 is the moving image and where the panel response time adjustment is unnecessary, the display 180 displays an image in the normal mode.

That is, in a case where the panel response time adjustment is unnecessary, during the first duration Pon1, the display 180 displays a portion of the n frame image on the upper portion of the OLED panel 210 and displays a portion of the n−1 frame image on the lower portion of the OLED panel 210. Furthermore, during second duration Poff1, the display 180 displays the n frame image on all display areas of the OLED panel 210.

To do this, during the first duration Pon1 and the second duration Poff1, an electric current IOLEDb that flows through the organic light-emitting layer preferably maintains the high level L2. In the drawings, it is illustrated that the electric current IOLEDb that flows through the organic light-emitting layer maintains the high level L2.

Next, FIG. 12C is a diagram illustrating another example of the image display in the panel response time adjustment mode.

With reference to the drawings, a method of displaying an image in FIG. 12.0 similar to FIG. 12A is similar to the method of displaying an image in the panel response time adjustment mode, but a difference lies in the fact that the frame image display duration is not the same as the black image display duration.

That is, FIG. 12A illustrates that the durations Pon1, Pon2, and Pon3 during which the frame image is displayed are the same as the duration Poff1, Poff2, and Poff3 during which the black image is displayed, but a difference lies in the fact that in FIG. 12C, the duration Poff1, Poff2, and Poff3 during which the black image is displayed is longer than durations Pon1, Pon2, and Pon3 during which the frame image is displayed.

That is, the controller 170 or a timing controller 232 is configured to, when the amount of movement of the object within the moving image is equal to or greater than the predetermined value, increase a length of the second duration rather than a length of the first duration as the movement of the object within the moving image increase.

Figure 13:
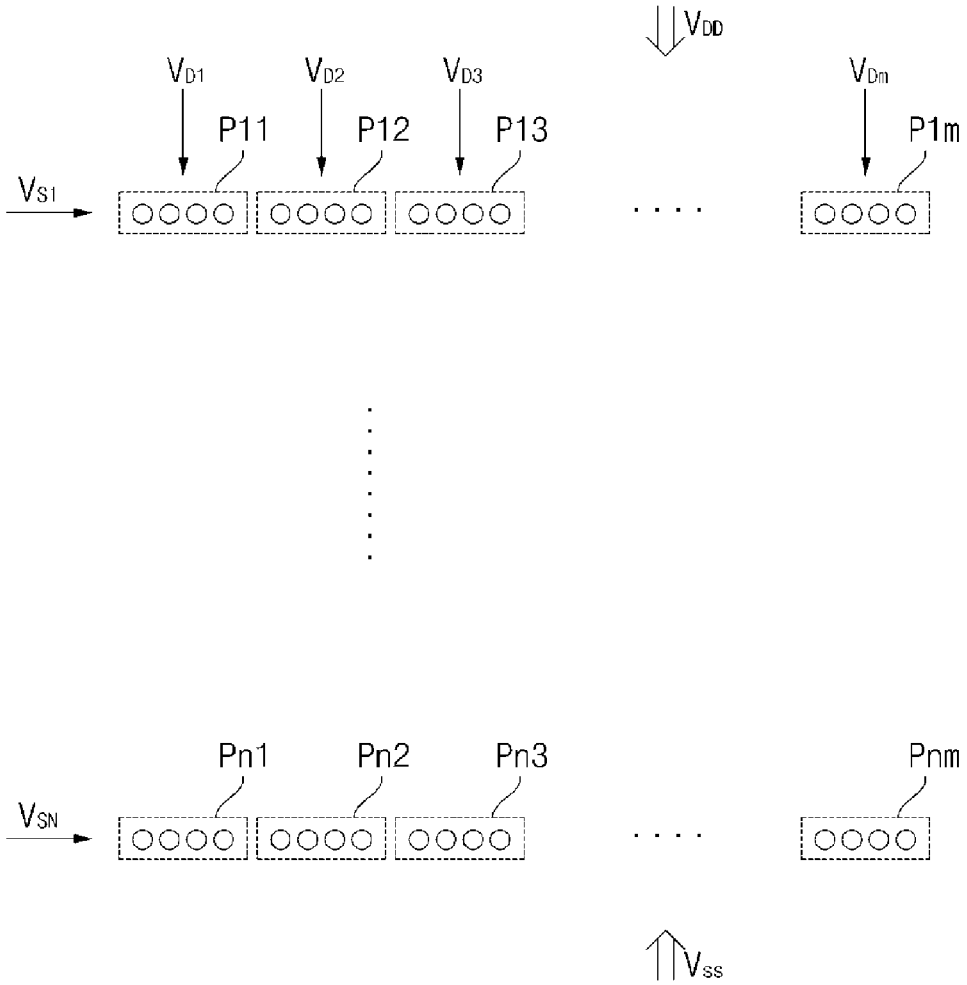
FIG. 13 is a diagram referred to for description of a voltage applied to each pixel of the organic light-emitting pane.

On the other hand, unlike in FIG. 12C, in a case where the amount of movement of the object within the moving image is decreased, it is also possible that the second duration, during which the black image is displayed, is shortened more than the first duration during which the frame image is displayed. FIG. 13 is a diagram referred to for description of a voltage applied to each pixel of the organic light-emitting pane.

With reference to FIGS. 9 and 13, the display 180 includes a plurality of pixels P11 and so forth up to Pnm that are organic light-emitting pixels.

The timing controller 232 applies scan voltages Vs1 and so forth Vsn to pixels, respectively, that correspond to the same horizontal line, among a plurality of pixels.

The timing controller 232 applies data voltages Vd1 and so forth up to Vdm to pixels, respectively, that correspond to the same vertical line, among the plurality of pixels.

On the other hand, the timing controller 232 applies the first voltage VDD and the second voltage VSS, which are described with reference to FIG. 9, to each of the pixels P11 and so forth up to Pnm.

In addition, in a case where first conductive lines for applying the first voltage VDD are connected in parallel to the pixels P11 and so forth up to Pnm, respectively, and where second conductive lines for applying the second voltage Vss are connected in parallel to the pixels P11, and so forth up to Pnm, respectively, the timing controller 232 may apply the first voltage VDD through the shared first conduction line, and may apply the second voltage Vss through the shared second conductive line.

In this case, it is also possible that the first switching element SW3 connected to the cathode of the organic light-emitting layer (OLED) of each pixel is provided to each pixel. However, aside from this, it is also possible that only one first switching element SW3 is provided through the shared conductive line.

Figure 14:
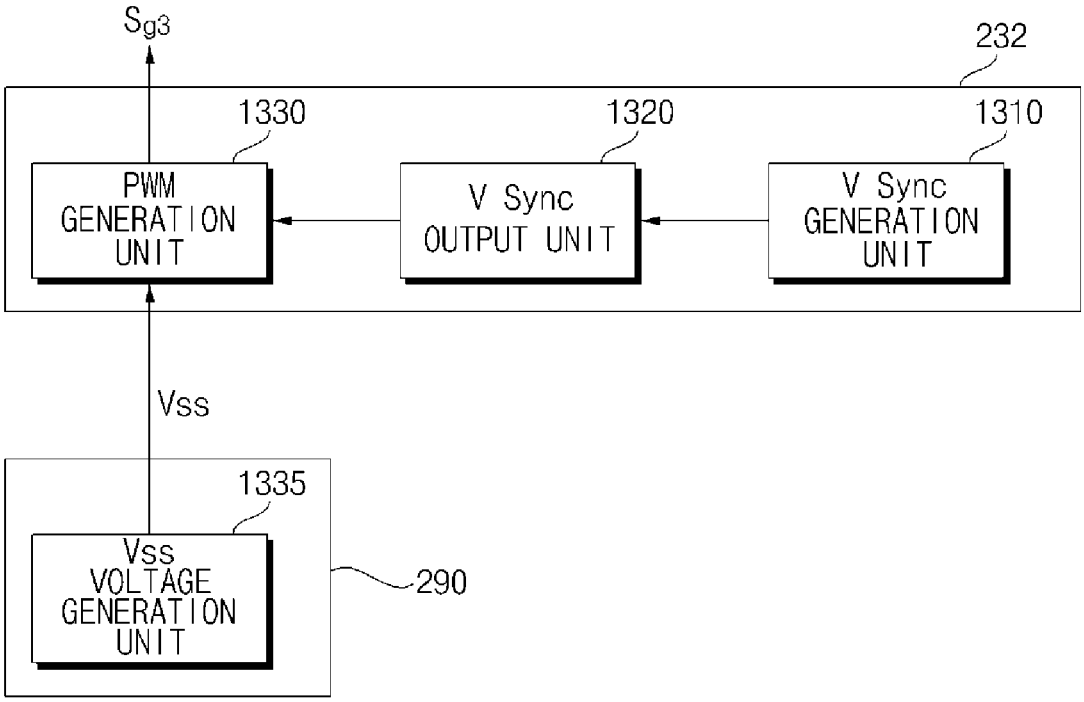
FIG. 14 is an example of a block diagram of the inside of a timing controller in FIG. 5.

FIG. 14 is an example of a block diagram of the inside of the timing controller in FIG. 5.

With reference to the drawings, the power supply unit 290 includes a second voltage generation unit 1335 and a first voltage generation unit (not illustrated).

On the other hand, in order to output the pulse signal Sg3, the timing controller 232 includes a vertical synchronization signal generation unit 1310, a vertical synchronization signal output unit 1320, and a PWM generation unit 1330.

The vertical synchronization signal generation unit 1310 generates the vertical synchronization signal Vsync in order to display an image on a per-frame basis. The vertical synchronization signal, as described above, corresponds to a frame frequency for the image display.

The vertical synchronization signal generation unit 1310 generates a first vertical synchronization signal in the normal mode, and generates a second vertical synchronization signal in the panel response time adjustment mode.

At this time, a frequency that corresponds to the first vertical synchronization signal is preferably higher than a frequency that corresponds to the second vertical synchronization signal. For example, the frequency that corresponds to the second vertical synchronization signal is two times higher than the frequency that corresponds to the first vertical synchronization signal.

Next, the vertical synchronization signal output unit 1320 fixes the vertical synchronization signal output from the vertical synchronization signal generation unit 1310, and outputs the fixed vertical synchronization signal. In addition, it is also possible that the vertical synchronization signal is changed and that the changed vertical synchronization signal is output.

For example, the vertical synchronization signal output unit 1320 outputs the first vertical synchronization signal in the normal mode, and outputs the second vertical synchronization signal in the panel response time adjustment mode.

As another example, while the vertical synchronization signal output unit 1320 outputs the second vertical synchronization signal, the more the amount of the movement of the object within the moving image is increased with the amount of the movement being equal to or greater than the predetermined value, the more the frequency of the second vertical synchronization signal and so on the vertical synchronization signal output unit 1320 changes. Then, the vertical synchronization signal output unit 1320 outputs the second vertical synchronization signal at the changed frequency.

Next, based on the vertical synchronization signal input, the PWM generation unit 1330 outputs the pulse signal Sg3 for driving the first switching element SW3.

For example, in the panel response time adjustment mode, the PWM generation unit 1330 receives the second vertical synchronization signal as an input, outputs the pulse signal Sg3 synchronized to the second vertical synchronization signal, and outputs the generated pulse signal Sg3. Accordingly, the first switching element SW3 performs switching.

As another example, in the normal mode, the PWM generation unit 1330 receives the first vertical synchronization signal as an input and outputs a low-level signal instead of the pulse signal.

On the other hand, in the panel response time adjustment mode, the timing controller 232 is configured to, during the first duration, display a portion of the first frame image on the first area of the OLED panel 210 and display a portion of the second frame image before the first frame image on the second area other than the first area of the OLED panel 210, and, during the second duration after the first duration, display the black image on all display areas of the OLED panel 210.

On the other hand, in the panel response time adjustment mode, the timing controller 232 is configured to, when the amount of movement of the object within the moving image is equal to or greater than the predetermined value, increase a length of the second duration rather than a length of the first duration as the movement of the object within the moving image increase.

On the other hand, in the panel response time adjustment mode, the timing controller 232 is configured to apply the first voltage VDD to the drive switching element SW2 and in such a manner that the pulse voltage Vps is applied to the cathode of the organic light-emitting layer (OLED). At this point, a low section of the pulse voltage Vps corresponds to the first duration, and a high section of the pulse voltage Vps corresponds to the second duration.

On the other hand, in the panel response time adjustment mode, the timing controller 232 is configured to apply the pulse signal Sg3 to the gate terminal of the first switching element SW3 and in such a manner that, based on the applied pulse signal Sg3, the pulse voltage Vps is applied to the cathode of the organic light-emitting layer (OLED).

On the other hand, in the panel response time adjustment mode, the timing controller 232 is configured to repeatedly turn on and off the drive switching element SW2 based on the pulse voltage Vps.

On the other hand, in the panel response time adjustment mode, the timing controller 232 is configured to, during the third duration after the second duration, display a portion of the third frame image after the first frame image on the first area of the OLED panel 210 and display another portion of the first frame image on the second area of the OLED panel 210 and in such a manner that during the fourth duration after the third duration, the black image is displayed on all display areas of the OLED panel 210.

On the other hand, in a case where the moving image to be displayed on the OLED panel 210 is the moving image and where the amount of the movement of the object within the moving image is below the predetermined value, the timing controller 232 perform control in such a manner that the panel response time adjustment mode is not performed.

On the other hand, in a case where panel (210) response time adjustment is necessary, the timing controller 232 is configured to apply the pulse voltage Vps to the cathode of the organic light-emitting layer (OLED).

On the other hand, in a case where the panel (210) response time adjustment is unnecessary, the timing controller 232 is configured to apply a low-level voltage GND to the cathode of the organic light-emitting layer (OLED).

On the other hand, in the case where the panel (210) response time adjustment is necessary, the timing controller 232 is configured to repeat the frame image display and the black image display are according to the low level and the high level of the pulse voltage Vps.

On the other hand, in the case where the panel (21) response time adjustment is necessary, the timing controller 232 is configured to, during the first duration, display a portion of the n frame image is displayed on the upper portion of the OLED panel 210 and display a portion of the n−1 frame image on the lower portion of the OLED panel 210 and in such a manner that during the second duration after the first duration, the black image is displayed on all display areas of the OLED panel 210.

On the other hand, in the case where the panel (210) response time adjustment is unnecessary, the timing controller 232 is configured to, during the first duration, display a portion of the n frame image is displayed on the upper portion of the OLED panel 210 and a portion of the n−1 frame image is displayed on the lower portion of the OLED panel 210 and in such a manner that during the second duration, the n frame image is displayed on all display areas of the OLED panel 210.

On the other hand, the timing controller 232 is configured to, during the third duration after the second duration, display a portion of the n+1 frame image is displayed on the upper portion of the OLED panel 210 and another portion of the n frame image is displayed on the lower portion of the OLED panel 210 and in such a manner that during the fourth duration after the third duration, the black image is displayed on all display areas of the OLED panel 210.

On the other hand, the timing controller 232 is configured to, during the first duration, display another portion of the n frame image is stored in the storage capacitor Cst and in such a manner that during the third duration, another portion of the n frame image stored in the storage capacitor Cst is displayed on the lower portion of the OLED panel 210.

Figure 15:
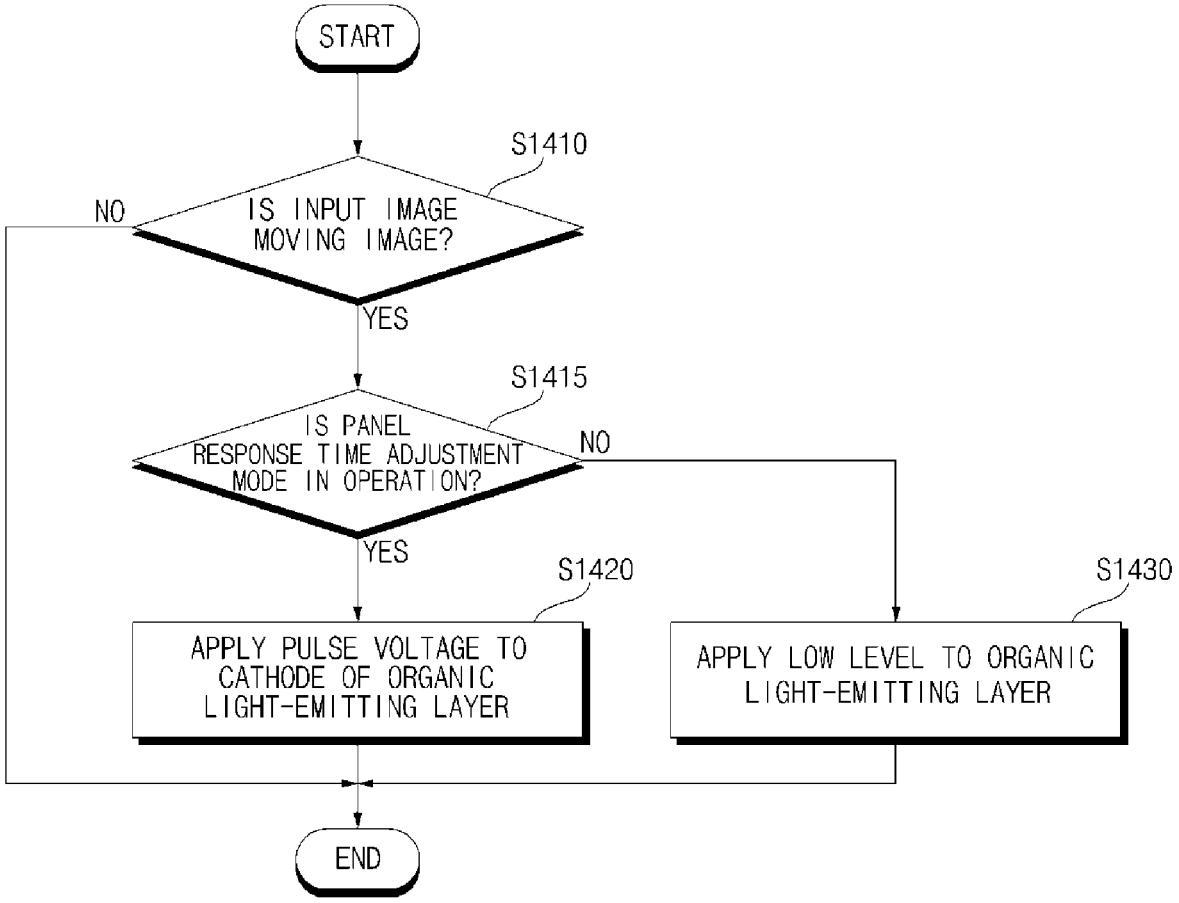
FIG. 15 is a flowchart illustrating a method in which the image display apparatus operates, according to an embodiment of the present invention.

FIG. 15 is a flowchart illustrating a method in which the image display apparatus operates, according to an embodiment of the present invention.

With reference to the drawings, the controller 170 or the timing controller 232 determines whether or not an input image is the moving image (S1410).

For example, in a case where there is a movement of an object within a plurality of frame images, it is determined whether or not the input image is the moving image.

In addition, it is determined whether or not the input image is the moving image, based on information added to the input image.

Next, in a case where the moving image has to be displayed, the controller 170 or the timing controller 232 determines whether or not the panel response time adjustment mode in which the panel response time adjustment is necessary is in operation (S1415).

For example, in the case where the moving image to be displayed on the OLED panel 210 is the moving image and where the amount of the movement of the object within the moving image is equal to or greater than the predetermined value, the controller 170 or the timing controller 232 is configured to enter the panel response time adjustment mode.

Next, in a case where the panel response time adjustment mode is entered, the timing controller 232, as illustrated in FIG. 10B, 11B, or 12A, the timing controller 232 is configured to apply the pulse voltage Vps described above to the cathode of the organic light-emitting layer (OLED) within the pixel (S1420).

Accordingly, the frame image display and the black image display are repeated, and accordingly, the phenomenon where an image leaves a trail occurs less frequently.

Next, in a case where instead of the panel response time adjustment mode, the normal mode is in operation, the timing controller 232, as illustrated in FIG. 11A or 12B, is configured to apply a fixed low-level voltage to the cathode of the organic light-emitting layer (OLED) within the pixel (S1430).

Figure 16:
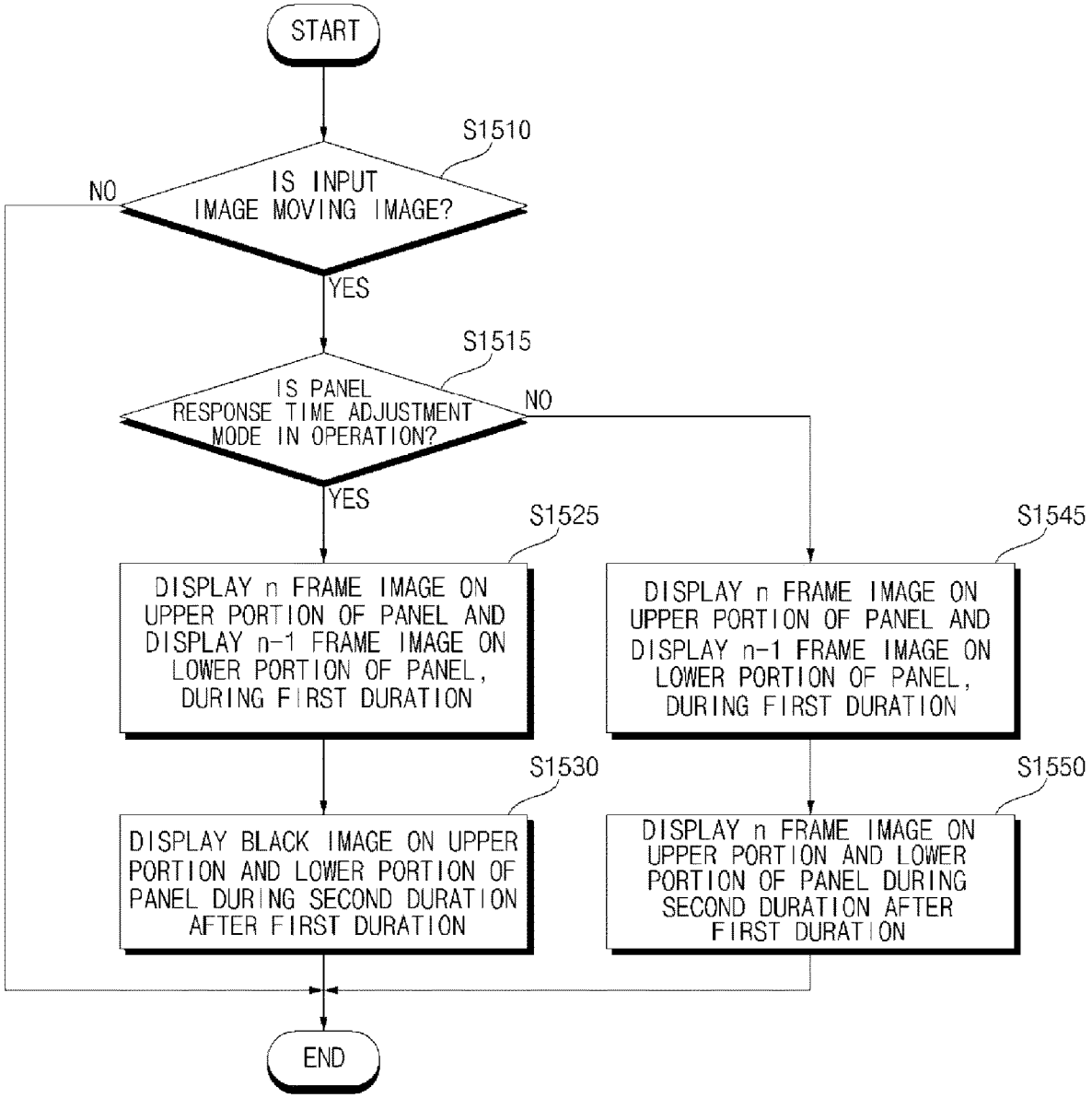
FIG. 16 is a flowchart illustrating a method in which the image display apparatus operates, according to another embodiment of the present invention.

Accordingly, only the image display is possible without displaying the black image. FIG. 16 is a flowchart illustrating a method in which the image display apparatus operates, according to another embodiment of the present invention.

With reference to the drawings, Step 1510 (S1510) and Step 1515 (S1515) in FIG. 16 are the same as Step 1410 (S1410) and Step 1415 (S1415), respectively, in FIG. 15 and thus descriptions thereof are omitted.

Next, in the case where the panel response time adjustment mode is entered, the timing controller 232, as illustrated in FIG. 12A, is configured to, during the first duration, display a portion of the n frame image on the upper portion of the OLED panel 210 and display a portion of the n−1 frame image on the lower portion of the OLED panel 210 (S1525).

Then, the timing controller 232 is configured to, during second duration after the first duration, display the black image on all display areas of the OLED panel 210 (S1530).

Accordingly, the frame image display and the black image display are repeated, and accordingly, the phenomenon where an image leaves a trail occurs less frequently.

Next, in the case where instead of the panel response time adjustment mode, the normal mode is in operation, the timing controller 232, as illustrated in FIG. 12B, is configured to, during the first duration, display a portion of the n frame image on the upper portion of the OLED panel 210 and display a portion of the n−1 frame image on the lower portion of the OLED panel 210 (S1545).

Then, the timing controller 232 is configured to, during second duration after the first duration, display the n frame image on all display areas of the OLED panel 210 (S1550).

Accordingly, it is possible to display frame image without displaying the black image.

As is apparent from the above description, according to an embodiment of the present invention, there is provided an image display apparatus includes a display including an organic light-emitting diode (OLED) panel, and a controller to control the organic light-emitting diode (OLED) panel, in which, in a case where an image to be displayed on the OLED panel is a moving image, during a first duration, the display displays a portion of a first frame image on a first area of the organic light-emitting diode (OLED) panel and displays a portion of a second frame image before the first frame image on a second area other than the first area of the organic light-emitting diode (OLED) panel, and in which, in the case where the image to be displayed on the organic light-emitting is the moving image, during a second duration after the first duration, the display displays a black image on all display areas of the organic light-emitting diode (OLED) panel. Thus, a panel response speed is improved when displaying the moving image.

Accordingly, the image is displayed in accordance with a high image quality standard when the moving image is displayed on the image display apparatus that includes the organic light-emitting diode (OLED) panel.

On the other hand, the more an amount of movement of an object within the moving image is increased with the amount of the movement being equal to or greater than a predetermined value, the more the second duration during which the black image is displayed is set to be lengthened rather than the first duration. Thus, the panel response time is adaptively improved when displaying the moving image.

Particularly, in the case where the moving image to be displayed on the organic light-emitting diode (OLED) panel is the moving image, a first voltage is applied to a drive switching element, and a pulse voltage is applied to a cathode of an organic light-emitting layer. Thus, frame image display during the first duration and black image display during the second duration are simply realized.

On the other hand, during a third duration after the second duration, a third frame image after the first frame image is displayed on the first area of the organic light-emitting diode (OLED) panel, and another portion of the first frame image stored in a storage capacitor is displayed on the second area of the organic light-emitting diode (OLED) panel. Thus, the panel response speed is improved when displaying the moving image.

On the other hand, an image display apparatus according to another embodiment of the present invention includes a display including an organic light-emitting diode (OLED) panel, and a controller to control the organic light-emitting diode (OLED) panel, in which the organic light-emitting diode (OLED) panel includes a plurality of pixels, in which the pixel includes an organic light-emitting layer, a drive switching element connected to an anode of the organic light-emitting layer and performs switching, and a first switching element connected between a cathode of the organic light-emitting layer and the ground, and in which, in a case where panel response time adjustment is necessary, the display applies a pulse voltage to the cathode of the organic light-emitting layer. Thus, the panel response time is improved when displaying the moving image.

On the other hand, an image display apparatus according to still another embodiment of the present invention includes a display including an organic light-emitting diode (OLED) panel, and a controller to control the organic light-emitting diode (OLED) panel, in which, in a case where panel response time adjustment is necessary, during a first duration, the display displays a portion of an n frame image on an upper portion of the organic light-emitting diode (OLED) panel and displays a portion of an n−1 frame image on a lower portion of the organic light-emitting diode (OLED) panel, and in which, in the case where the panel response time adjustment is necessary, during a second duration after the first duration, the display displays a black image on all display areas of the organic light-emitting diode (OLED) panel. Thus, the panel response speed is improved when displaying the moving image.

On the other hand, the method in which the image display apparatus according to the present invention operates is possibly realized as processor-readable codes on a recording medium readable by a processor which is included in the image display apparatus. Processor-readable recording media include all types of recording devices on which processor-readable data is stored. Examples of the processor-readable recording medium include a ROM, a RAM, a CD-ROM, a magnetic tape, a floppy disk, an optical data storage device, and so on, and also include a medium realized in the form of a carrier wave such as one transferred through the Internet. In addition, codes that are to be distributed among computer systems connected to a network and that are to be readable in a distributed manner are stored on the processor-readable recording medium, and the codes on the processor-readable recording medium is executed.

In addition, the desirable embodiments of the present embodiment are described above using the illustrations by the drawings, but the present invention is not limited to the specific embodiments described. It is, of course, apparent to a person of ordinary skill in the related art that various modifications are possible without departing from the gist of the present invention set forth in Claim. The various embodiments should not be individually understood from the technical idea or aspects of the present invention.

What is claimed is:

1. An image display apparatus comprising:

a display including an organic light-emitting diode (OLED) panel; and a controller to control the OLED panel, wherein when an image to be displayed on the OLED panel is a moving image, the display displays a portion of a first frame image on a first area of the OLED panel and displays a portion of a second frame image before the first frame image on a second area other than the first area of the OLED panel during a first duration, and wherein when an image to be displayed on the OLED panel is a moving image, the display displays a black image on all display areas of the OLED panel during a second duration after the first duration, wherein the OLED panel includes a plurality of pixels, wherein the pixel includes:

an organic light-emitting layer, and a drive switching element connected to an anode of the organic light-emitting layer and performs switching, and wherein when the image to be displayed on the OLED panel is the moving image, a first voltage is applied to the drive switching element, and a pulse voltage is applied to a cathode of the organic light-emitting layer.

2. The image display apparatus according to claim 1, wherein when the image to be displayed on the OLED panel is the moving image and an amount of movement of an object within the moving image is equal to or greater than a predetermined value, the controller is configured to enter a panel response time adjustment mode, wherein, according to the panel response time adjustment mode, during the first duration, the display displays the portion of the first image on the first area of the OLED panel and displays the portion of the second frame image on the second area other than the first area of the OLED panel, and wherein, according to the panel response time adjustment mode, during the second duration after the first duration, the display displays the black image on the all display areas of the OLED panel.

3. The image display apparatus according to claim 2, wherein when the amount of movement of the object within the moving image is equal to or greater than the predetermined value, the controller is configured to increase a length of the second duration rather than a length of the first duration as the movement of the object within the moving image increase.

4. The image display apparatus according to claim 2, wherein when the image to be displayed on the OLED panel is the moving image and the amount of movement of the object within the moving image is less than the predetermined value, the controller is configured not to perform the panel response time adjustment mode.

5. The image display apparatus according to claim 1, wherein a low section of the pulse voltage corresponds to the first duration and a high section of the pulse voltage corresponds to the second duration.

6. The image display apparatus according to claim 1, further comprising:

a first switching element connected between the cathode of the organic light-emitting layer and the ground, wherein when the image to be displayed on the OLED panel is the moving image, a pulse signal is applied to a gate terminal of the first switching element and the pulse voltage is applied to the cathode of the organic light-emitting layer based on the applied pulse signal.

7. The image display apparatus according to claim 6, wherein the first voltage is applied to the first switching element.

8. The image display apparatus according to claim 6, wherein the display further includes a PWM generation unit that generates a pulse signal based on a vertical synchronization signal and outputs the generated pulse signal to the first switching element.

9. The image display apparatus according to claim 1, wherein the drive switching element is repeatedly turned on and off based on the pulse voltage.

10. The image display apparatus according to claim 1, wherein during the first duration during which the drive switching element is turned on, the display displays the portion of the first frame image on the first area of the OLED panel and displays the portion of the second frame image before the first frame image on the second area other than the first area of the OLED panel, and wherein during the second duration during which the drive switching element is turned off, the display displays the black image on the all display areas of the OLED panel.

11. The image display apparatus according to claim 1, wherein the pixel further includes a scan switching element to which a scan signal is applied, and a storage capacitor connected between the scan switching element and the drive switching element, wherein during the first duration, another portion of the first frame image is stored in the storage capacitor, and wherein during a third duration after the second duration, the display displays a third frame image after the first frame image on the first area of the OLED panel, and displays another portion of the first frame image stored in the storage capacitor on the second area of the OLED panel.

12. The image display apparatus according to claim 1, wherein during a third duration after the second duration, the display displays a portion of a third frame image after the first frame image on the first area of the OLED panel, and displays another portion of the first frame image on the second area of the OLED panel, and wherein during a fourth duration after the third duration, the display displays the black image on the all display areas of the OLED panel.

13. An image display apparatus comprising:

a display including an organic light-emitting diode (OLED) panel; and a controller to control the OLED panel, wherein, in a panel response time adjustment mode, during a first duration, the display displays a portion of an n frame image on an upper portion of the OLED panel and displays a portion of an n−1 frame image on a lower portion of the OLED panel, and wherein, in the panel response time adjustment mode, the display displays a black image on all display areas of the OLED panel during a second duration after the first duration, wherein the OLED panel includes a plurality of pixels, wherein the pixel includes:

an organic light-emitting layer, and a drive switching element connected to an anode of the organic light-emitting layer and performs switching, and wherein when the image to be displayed on the OLED panel is a moving image, a first voltage is applied to the drive switching element, and a pulse voltage is applied to a cathode of the organic light-emitting layer.

14. The image display apparatus according to claim 13, wherein, except in the panel response time adjustment mode, during the first duration, the display displays a portion of the n frame image on the upper portion of the OLED panel and displays a portion of the n−1 frame image on the lower portion of the OLED panel, and wherein, except in the panel response time adjustment mode, during the second duration, the display displays the n-frame image on the all display areas of the OLED panel.

15. The image display apparatus according to claim 13, wherein during a third duration after the second duration, the display displays a portion of an n+1 frame image on the upper portion of the OLED panel, and displays another portion of the n frame image on the lower portion of the OLED panel, and wherein during a fourth duration after the third duration, the display displays the black image on the all display areas of the OLED panel.

16. The image display apparatus according to claim 13, wherein the display includes the organic light-emitting layer, the drive switching element connected to the anode of the organic light-emitting layer and performs switching, a scan switching element to which a scan signal is applied, and a storage capacitor connected between the scan switching element and the drive switching element, wherein during the first duration, another portion of the n frame image is stored in the storage capacitor, and wherein during a third duration after the second duration, another portion of the n frame image stored in the storage capacitor is displayed on the upper portion of the OLED panel.

* * * * *